US008826576B2

(12) United States Patent
Lewis

(10) Patent No.: US 8,826,576 B2
(45) Date of Patent: Sep. 9, 2014

(54) FIREARM BOLT

(76) Inventor: Karl R. Lewis, Moline, IL (US)

( * ) Notice: Subject to any disclaimer, the term of this patent is extended or adjusted under 35 U.S.C. 154(b) by 181 days.

(21) Appl. No.: 13/571,945

(22) Filed: Aug. 10, 2012

(65) Prior Publication Data

US 2014/0075807 A1 Mar. 20, 2014

Related U.S. Application Data

(60) Provisional application No. 61/522,438, filed on Aug. 11, 2011.

(51) Int. Cl.
*F41A 15/00* (2006.01)

(52) U.S. Cl.
USPC ..... 42/25; 42/16; 42/69.01

(58) Field of Classification Search
USPC ..... 42/16, 25, 69.02; 89/185
See application file for complete search history.

(56) References Cited

U.S. PATENT DOCUMENTS

| | | | |
|---|---|---|---|
| 2,198,610 | A | 4/1940 | Garand |
| 2,421,249 | A | 5/1947 | Delsole |
| 2,603,019 | A | 7/1952 | Elkas |
| 2,603,020 | A | 7/1952 | Hussey |
| 3,882,625 | A | 5/1975 | Tellie |
| 4,066,000 | A | 1/1978 | Rostocil |
| 4,265,043 | A | 5/1981 | Rowlands |
| 5,307,724 | A | 5/1994 | Breuer et al. |
| 6,176,169 | B1 | 1/2001 | Rostocil |
| 6,260,297 | B1 | 7/2001 | Schmees |
| 6,484,430 | B1 | 11/2002 | Robinson et al. |
| 6,625,917 | B2 | 9/2003 | Murello et al. |
| 6,966,137 | B2 | 11/2005 | Gussalli Beretta |
| 7,478,494 | B2 | 1/2009 | Zeh |
| 2006/0070288 | A1 | 4/2006 | Zedrosser |
| 2010/0162605 | A1 | 7/2010 | Laney et al. |

*Primary Examiner* — Daniel J Troy

(74) *Attorney, Agent, or Firm* — Woodard, Emhardt, Moriarty, McNett & Henry LLP

(57) ABSTRACT

Disclosed is a firearm bolt that may optionally incorporate one or more ejectors that are located closer to the extractor. The disclosed firearm bolt may also optionally position the ejector(s) outside of a central portion of a cartridge that experience high compression forces when the cartridge is fired.

24 Claims, 23 Drawing Sheets

FIREARM BOLT

CROSS-REFERENCE TO RELATED APPLICATIONS

This application claims the benefit of U.S. Provisional Application No. 61/522,438, filed Aug. 11, 2011, which is hereby incorporated by reference.

BACKGROUND

The M16 automatic rifle is a standard weapon of choice for many institutions around the world including the U.S. military and many law enforcement agencies. Over the years the M16 has been modified to include a large family of weapons including semi-automatic counterparts which are popular in the civilian sector. Generally, the M16 family of automatic and semi-automatic rifles is based on a gas operated rotating bolt carrier system. The bolt carrier includes a multi-lug bolt that interlocks with corresponding lugs within a barrel extension engaged to the barrel to contain the firing of each round of ammunition. The bolt carrier system includes a rotating mechanism that locks the bolt into place with respect to the barrel extension during the loading step and also includes a corresponding unlocking motion when extracting a spent casing. The bolt includes a spring loaded extractor configured to releasably engage a cartridge as it is loaded into the firing chamber. When the rifle is fired the interlock bolt contains the firing force by transmitting the force through the lugs to corresponding lugs of the barrel extension.

When a round is fired, gas pressure is vented from a port in the barrel down from the firing chamber and that gas pressure is applied to the bolt carrier system to impart energy in a rearward direction. As the bolt carrier system moves rearwardly it first rotates the bolt to unlock the bolt lugs from the barrel extension lugs. Then, as it further recoils, the extractor pulls the expended cartridge from the firing chamber. Once the cartridge clears the firing chamber an ejector in the bolt pivots the cartridge about the extractor and ejects the spent cartridge as is well known in the art. As the bolt carrier system continues to move rearwardly its travel is halted by a spring that then pushes the bolt carrier system forward to engage and chamber another round. This process is repeated as often as desired by a shooter until the last cartridge in a magazine is expended.

DETAILED DESCRIPTION

Figure 1:
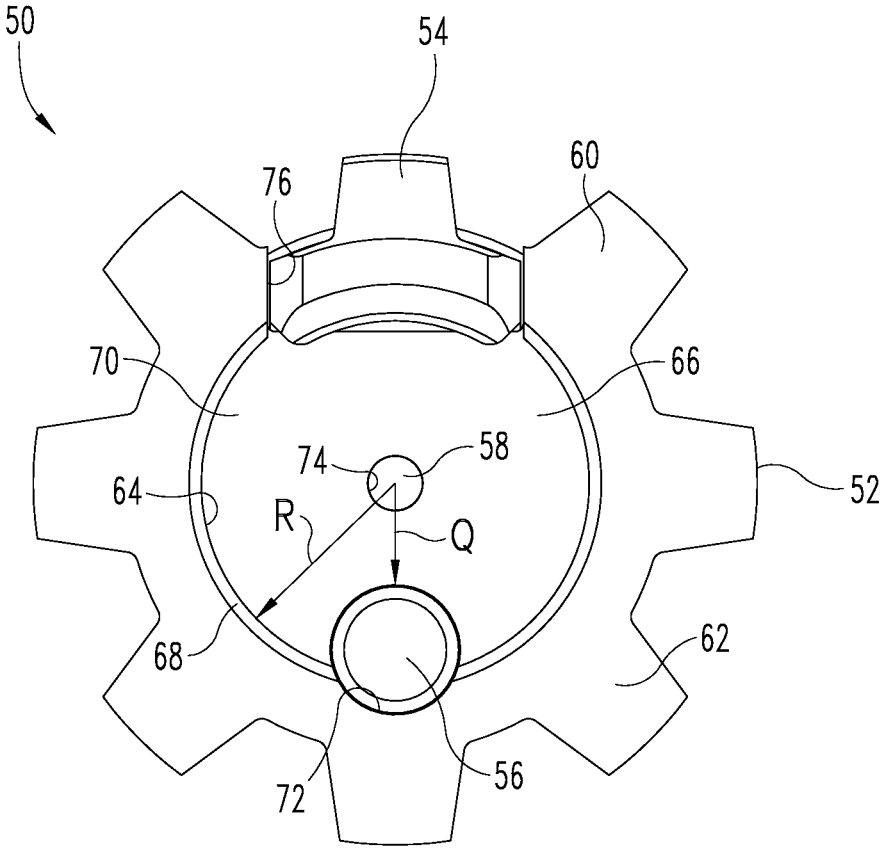
Fig. 1 (PRIOR ART)
FIG. 1 is a front elevational view of a first prior art bolt illustrating the bolt face.

Reference will now be made to certain embodiments and specific language will be used to describe the same. It will nevertheless be understood that no limitation of the scope of this disclosure and the claims is thereby intended, such alterations, further modifications and further applications of the principles described herein being contemplated as would normally occur to one skilled in the art to which this disclosure relates. In several figures, where there are the same or similar elements, those elements are designated with the same or similar reference numerals.

The present disclosure is related to incremental improvements for a firearm bolt. Specifically disclosed herein is a bolt configured and arranged for use in an 7.62 mm×51 mm NATO chambered battle rifle based on the AR10® design. However, the concepts disclosed herein can be adapted for use in many other types of firearms as would be apparent to a person of ordinary skill in the art, including, but not limited to, M16/AR15 type rotating bolt firearms chambered in other calibers such as 5.56 mm NATO or other high-powered firearms which can benefit from the present disclosure.

The M16/AR15 style weapon originated from the AR10® developed by Eugene Stoner in the late 1950s. The AR10® included several innovated features that were patented by Eugene Stoner in U.S. Pat. Nos. 2,951,424 and 3,198,076. The AR10® is chambered for 7.62×51 mm NATO (also 0.308 Winchester). Many of the unique features of the AR10® would eventually be developed into the US Army's M16 chambered for 5.56×45 mm NATO (.223 Remington). The AR15 is a semi-automatic civilian derivative of the selective fire M16 used by the US military.

Several rifle manufacturers currently produce .308 semi-automatic rifles that are scaled up from the AR15 design, including, but not limited to, DPMS LR-308, KAC SR-25, KAC M110, Rock River Arms LAR-8, American Spirit Arms ASA .308, Fulton Armory Titan, LW RC's R.E.P.R., LaRue Tactical's OBR, Heckler & Koch HK 417, RND Manufacturing's "The Edge" and the German Oberland Arms OA-10. As a point of reference, these AR15 types rifles chamber for 7.62 mm NATO cartridges generally have a cycle time between approximately 0.060 seconds and approximately 0.100 seconds.

Referring now to FIG. 1, a first prior art bolt 50 is illustrated in a front elevational view of the face of bolt 50. Bolt 50 is a scale illustration of an AR10® bolt for 7.62 mm×51 mm NATO cartridge. Bolt 50 includes bolt head 52, extractor 54, ejector 56 and firing pin 58. Bolt head 52 includes a plurality of lugs 60, forward face 62, wall 64, bolt face 66 and chamfer 68. Bolt head 52 also defines recess 70, channel 72, aperture 74 and slot 76.

Lugs 60 are constructed and arranged to be received in a corresponding locking barrel in a rotating bolt rifle. Lugs 60 pass through corresponding grooves in a barrel or barrel extension and then bolt 50 is rotated to engage lugs 60 with corresponding projections in the barrel or barrel extension (not illustrated) to lock bolt 50 in engagement with the barrel of the firearm. This encapsulates a cartridge in the firing chamber and provides rearward containment when the cartridge is fired.

Forward face 62 is the forward portion of bolt head 52 and includes portions of each of lugs 60. Wall 64 and bolt face 66 define recess 70 in bolt head 52 that is constructed and arranged to receive the base of a cartridge to be fired in a firearm.

Channel 72 is constructed and arranged to receive ejector 56 and a biasing means that biases ejector 56 to protrude beyond bolt face 66 to be approximately flush with forward face 62. Ejector 56 is pushed down to be flush with bolt face 66 when a cartridge is received in recess 70. Ejector 56 (with the biasing means) provides a force against a cartridge that promotes ejection of spent cartridges as part of the action of a firearm.

Aperture 74 is constructed and arranged to receive firing pin 58 and to allow firing pin 58 to protrude beyond bolt face 66 to strike a primer in the received cartridge as is well know in the art.

Slot 76 is constructed and arranged to receive extractor 54 and to allow extractor 54 to move radially away from bolt face 66 when a cartridge is received into recess 70.

Also illustrated in FIG. 1 is radius R, which is the distance between longitudinal axis D and wall 64. Also illustrated in FIG. 1 is distance Q, which is the distance between longitudinal axis D and the closest part of channel 72. In the illustrated AR10® bolt, distance Q equals approximately 53% of radius R.

Figure 2:
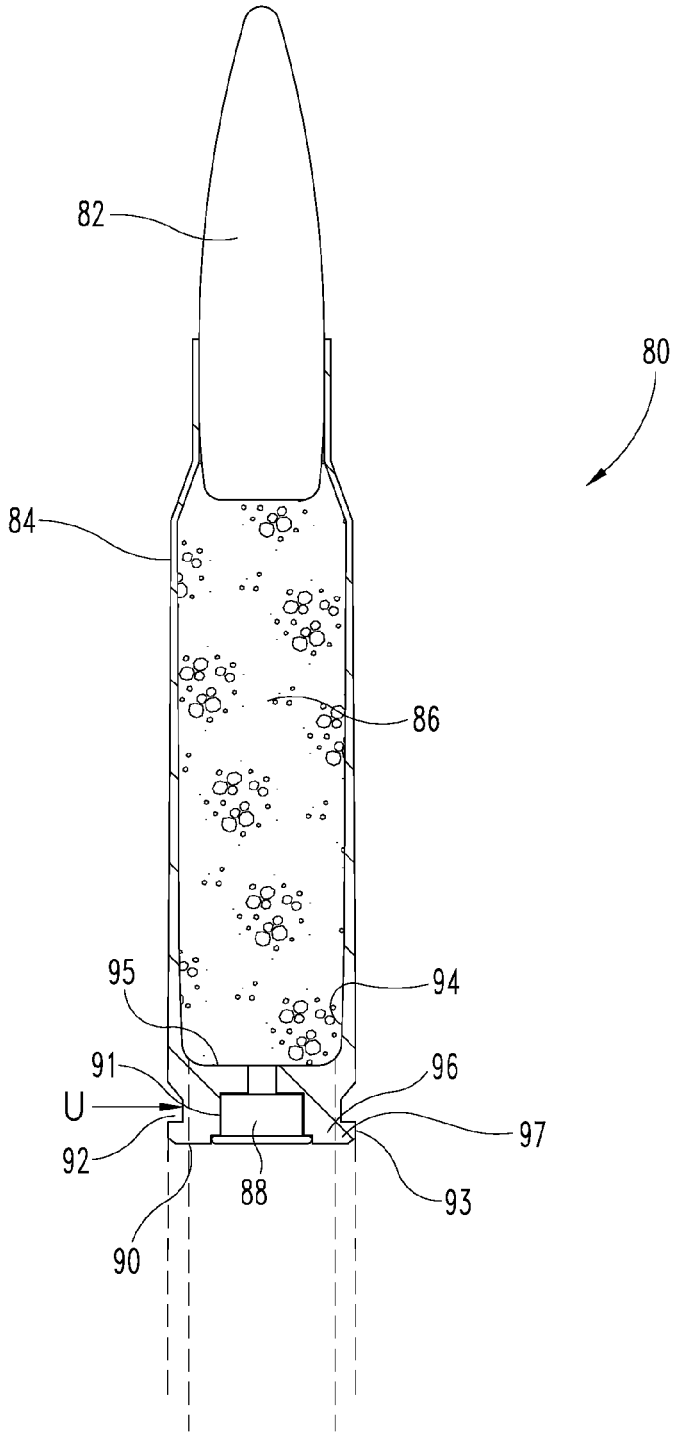
Fig. 2 (PRIOR ART)
FIG. 2 is a front elevational cross-sectional view of a prior art cartridge.

Referring now to FIG. 2, prior art cartridge 80 is illustrated. Cartridge 80 is a scaled approximation of an 7.62×51 mm NATO cartridge. Cartridge 80 includes bullet 82, casing 84, propellant 86 and primer 88. This is a standard cartridge configuration as is well known in the art with propellant 86 entrapped in casing 84 by bullet 82 and primer 88.

Casing 84 includes base 90, primer pocket 91, groove 92, rim 93, side wall 94 and bottom wall 95. The outer surface of the bottom of groove 92 defines radius U. Primer pocket 91 is constructed and arranged to receive primer 88. Rim 93 is defined by groove 92 with groove 92 and rim 93 being used for extraction purposes as described below. Cartridge 80 is commonly referred to as a "rimless" cartridge in the art because rim 93 does not extend radially outside of the outer diameter of casing 84.

Base 90 can be divided into two different portions, central portion 96 and peripheral portion 97. Central portion 96 includes the portion of base 90 directly below bottom wall 95. The remaining portion of base 90 is peripheral portion 97 which is located outside of and radially surrounding a projection of bottom wall 95 on base 90. Central portion 96 represents the portion of base 90 that generally experiences the greatest compressive forces when cartridge 80 is fired in a chamber. Peripheral portion 97 represents the portion of base 90 that experiences compressive forces insufficient to cause brass extrusion when cartridge 80 is fired in the chamber. Peripheral portion 97 includes all of rim 93.

Casing 84 may be constructed using a drawn brass forging technique that results in a variable thickness for side wall 94 with the portion of side wall 94 proximate to bullet 82 being substantially thinner than the portion of side wall 94 proximate to bottom wall 95. Therefore, the method of manufacture of casing 84 can effect the relative size of bottom wall 95 and the extent of center portion 96. Casing 84 is illustrated as a drawn brass forging.

Figure 4:
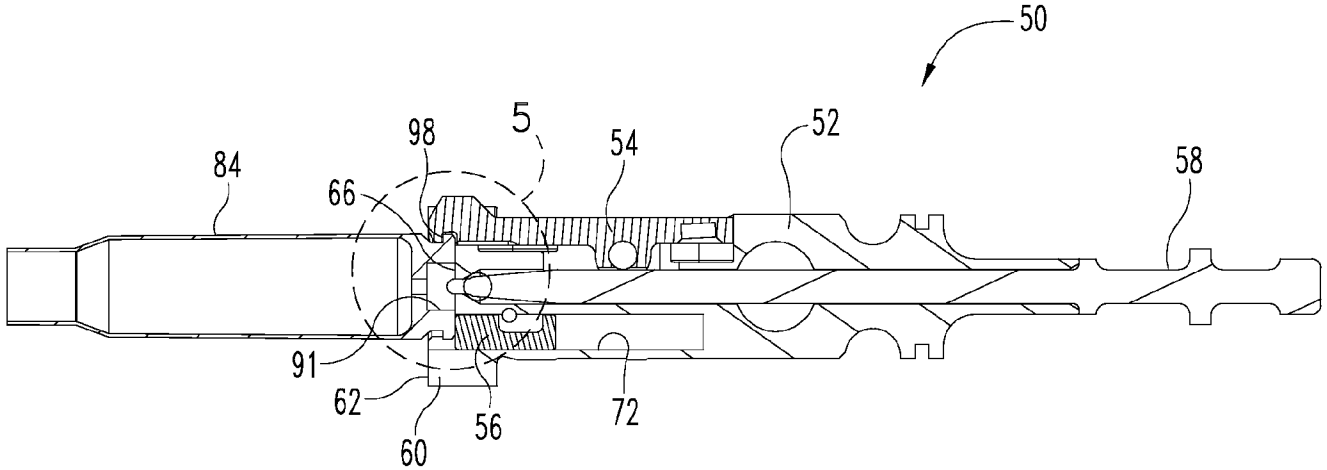
Fig. 4 (PRIOR ART)
FIG. 4 is a cross-sectional view of FIG. 3 taken along section line 4-4.
Figure 3:
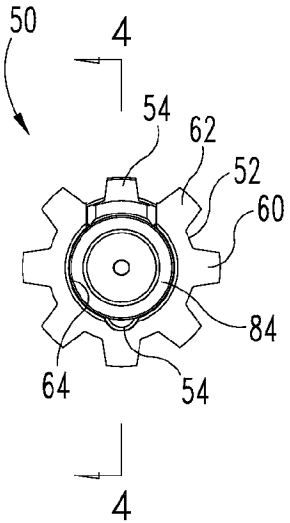
Fig. 3 (PRIOR ART)
FIG. 3 is a front elevational view of the FIG. 2 casing engaged with the FIG. 1 bolt.
Figure 5:
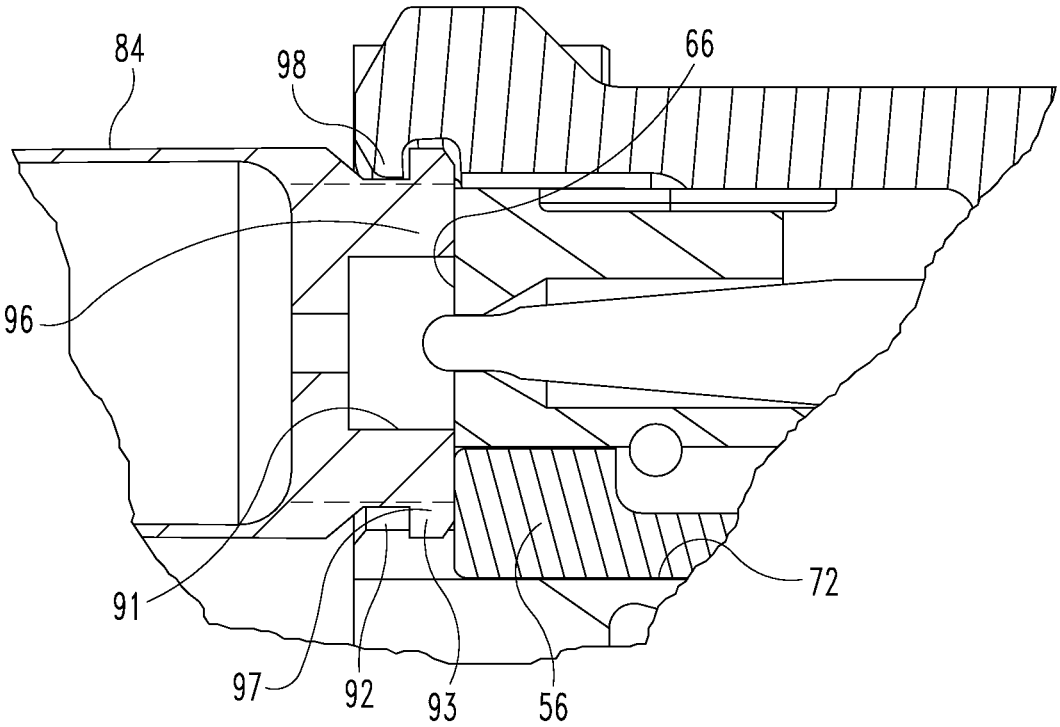
Fig. 5 (PRIOR ART)
FIG. 5 is a partial cross-sectional view taken inside line 5 of FIG. 4.

Referring now to FIGS. 3-5, a prior art engagement between casing 84 and bolt 50 is illustrated. As shown, base 90 is received in recess 70 and abuts against bolt face 66. As best seen in FIG. 5, ejector 56 bears against both central portion 96 and peripheral portion 97. This is significant because Applicant has identified a potential problem that this arrangement creates when cartridge 80 is fired. Propellant 86 can generate a tremendous amount of pressure within the breech of the firearm when cartridge 80 is fired. The radial portion of this pressure is contained by the barrel while the rearward portion is contained by bolt 50 due to the locking engagement between lugs 60 and corresponding projections in the barrel or barrel extension. The pressure forces bullet 82 (shown in FIG. 2) down the barrel at high velocity as it is being fired from the weapon.

As stated above, the rearward portion of the firing chamber is defined and contained by base 90 bearing against bolt face 66. Central portion 96 experiences significant amounts of compression against bolt face 66. In the areas where central portion 96 significantly overlays ejector 56 and channel 72, Applicant has identified that, in some cases, small amounts of brass can be extruded into that void space defined between ejector 56 and channel 72. This can occur due to ejector 56 being pushed below the level of bolt face 66 or this can occur in the gap between ejector 56 and channel 72 into which brass can extrude.

In the illustrated prior art system, after the round has been fired, gas can be ported from a distal portion of the barrel. This gas can be impinged either directly against a bolt carrier (carrying bolt 50) or against a piston that interacts with the bolt carrier. This imparts a rearward motion to the bolt carrier that is resisted by a return spring. As the bolt carrier begins to move rearward, bolt 50 is rotated, unlocking lugs 60 from engagement with the barrel. This generally occurs while there is still residual pressure in the chamber that pushes casing 84 against the barrel, which usually retards or prevents rotation of casing 84. Instead, bolt 50 generally rotates with respect to casing 84. Applicant has noted that when brass extrudes into channel 72 and/or the gap between channel 72 and ejector 56, that extruded brass may be subsequently sheared off when bolt head 52 is rotated to unlock lugs 60. Over time, brass particles can accumulate in the action of the firearm increasing fouling and adversely affecting performance.

After lugs 60 are disengaged, then bolt 50 (and bolt head 52) move rearwardly, and extract casing 84 from the chamber via projection 98 on extractor 54 that sits within groove 92 and engages rim 93. After casing 84 clears the barrel, the biased force of ejector 56 pushing against base 90 causes casing 84 to rotate about projection 98 and to be ejected.

Figure 6:
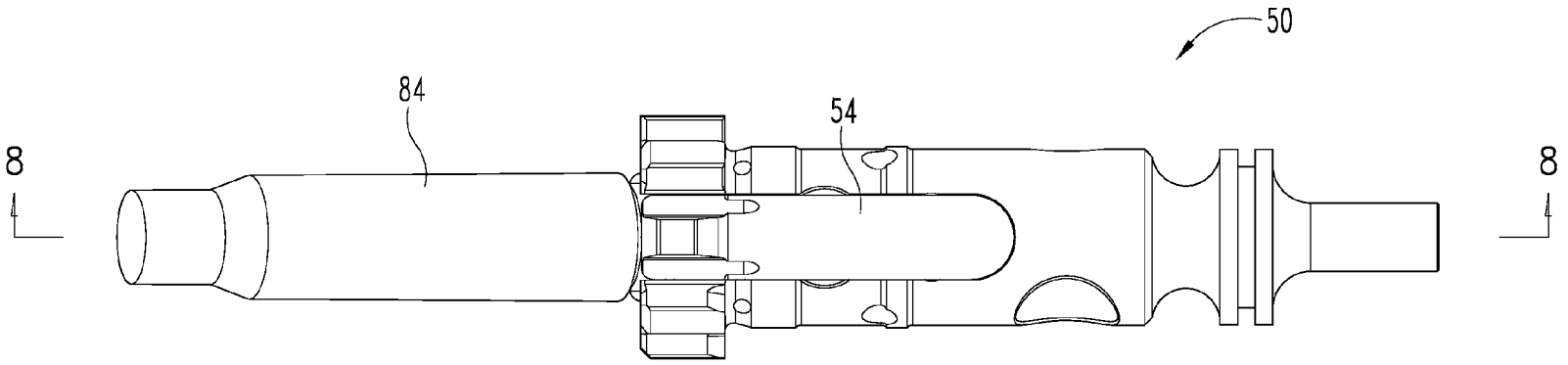
Fig. 6 (PRIOR ART)
FIG. 6 is a top plan view of the FIG. 1 bolt engaged with the FIG. 2 casing during ejection.
Figure 8:
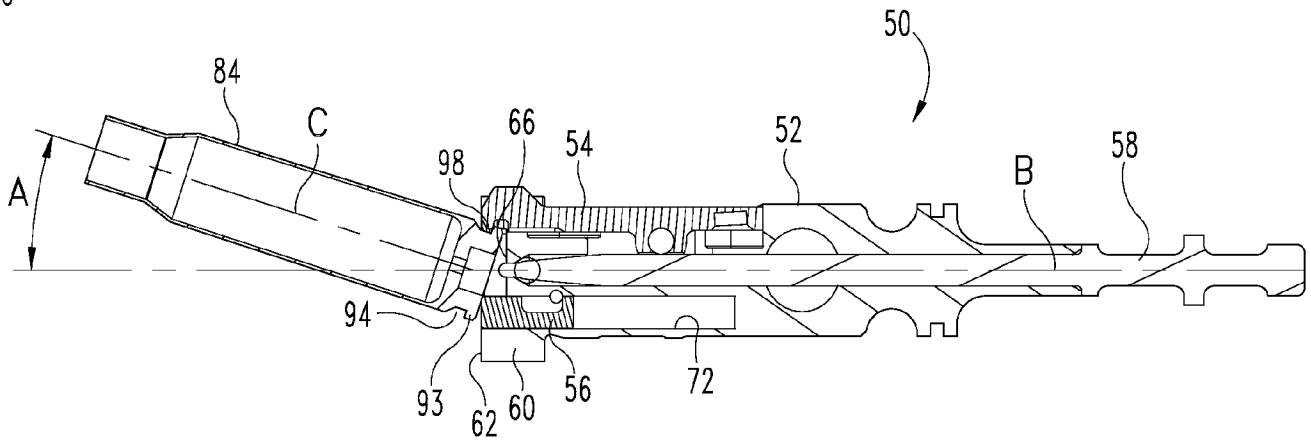
Fig. 8 (PRIOR ART)
FIG. 8 is a side cross-sectional view of FIG. 6 taken along section line 8-8.
Figure 7:
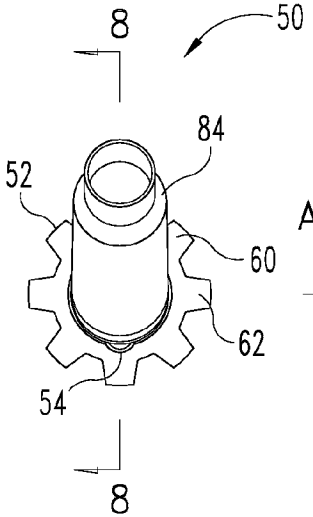
Fig. 7 (PRIOR ART)
FIG. 7 is a front elevational view of the FIG. 6 configuration.

Referring now to FIGS. 6-8, prior art bolt 50 and casing 84 are illustrated during the extraction process. In particular, in the condition wherein bolt 50 has moved rearwardly in the action of the weapon so that casing 84 clears the chamber of the barrel and ejector 56 has extended to its forward position substantially flush with forward face 62 causing casing 84 to rotate about projection 98. In the illustrated configuration, the angle between longitudinal axis B of bolt head 52 and longitudinal axis C of casing 84 is shown as angle A. In the illustrated configuration angle A is equal to approximately 18°. The process of moving ejector 56 forward imparts angular momentum combined with moving casing 84 rearwardly results in casing 84 continuing to rotate about projection 98 and to eventually leave the firing chamber making room for a subsequent round to be loaded by the action in the return stroke of bolt 50 forward.

Applicant has identified some situations in which the prior art ejection system illustrated in FIGS. 6-8 does not perform adequately. As background information, the system embodied in bolt 50 was originally developed for the AR10® type weapon platform utilizing a 20 inch (50.8 cm) barrel. The original 20 inch barrel included a distance of approximately 31.8 cm between the chamber of the barrel (rearmost portion of the chamber) and the extraction port where combustion gases were vented to operate the action of the firearm and to move bolt 50 to extract the spent casing. The AR10® type weapon chambered for the 7.62 mm NATO cartridge platform has been subsequently adapted for use as both a sniper weapon and as a carbine that required a shorter distance between the gas port and the chamber due to shortening the barrel from 20 inches to 16 inches (40.6 cm) or 14 inches (35.6 cm) or even shorter depending on the application. For example, a 16 inch barrel may have a gas port approximately 23.2 cm away from the rearmost portion of the chamber of the barrel. As another example, a 14 inch barrel may have a gas port approximately 18.1 cm away from the rearmost portion of the chamber of the barrel.

Moving the position of the gas port closer to the chamber had several effects. First higher pressure gas is vented to the action. This results in a corresponding increase in the energy imparted to bolt 50 during the extraction phase which results in higher velocities of bolt 50. Second, the energy from the vested gas begins the extraction process earlier. This can result in the extraction process beginning while casing 84 is still pressed against the firing chamber by combustion gases, increasing the amount of force required to extract the spent casing from the firing chamber.

Other firearm configurations had similar effects. For example, used in a special operation role, the AR10® type weapon platform has been adapted for use with sound suppressors on a shortened carbine barrel. In a sound suppressed configuration, a special cartridge 80 could be utilized having a reduced load of propellant 86 and/or higher weight bullet 82 to achieve subsonic bullet velocities from the firearm (the 7.62 mm×51 mm NATO cartridge is normally a supersonic cartridge). In this application, the shortened barrel and associated gas port is combined with reduced gas pressure from cartridge 80. This can result in insufficient pressure being vented to extract spent casing 84. As a result, a sound suppressed weapon may be additionally modified to use an action spring with a reduced energy storage capacity to stop the rearward movement of the bolt and to impart a reciprocal forward motion that chambers a subsequent cartridge.

In addition, operators using suppressed weapons desire the option of using full powered ammunition when required. For example, once stealth has been lost a fire fight may occur. An operator may want to be able to remove their magazine of specialized subsonic rounds and replace it with magazine loaded with normal combat rounds possessing normal cartridge loads for maximum efficacy. This situation has proved difficult for many weapons chambered for the 7.62 mm NATO to reliably operate. When utilizing a shortened carbine barrel in combination with the sound suppressor and full powered ammunition a high pressured situation is developed where full pressure combustion gases are ported to the action early combined with a sound suppressor that also increases gas pressure by retarding venting of gas through the muzzle of the barrel. This may be further combined with a modified action spring that provides less resistance to moving bolt 50 to reliably operate with lower pressure subsonic rounds. In this case, Applicant has observed that when bolt 50 is sufficiently over-energized by the higher gas pressure and/or earlier application of pressure, casings 84 are not reliably ejected from the action prior to the return stroke of bolt 50 occurring. In this situation, it has been observed where casings 84 jam in the action preventing loading of a subsequent round. In a combat situation this can be a catastrophic failure.

Referring now to FIGS. 9-12, a first inventive bolt 100 is illustrated. Bolt 100 includes bolt head 102, extractor 104, ejectors 106 and 108, firing pin 110, biasing members 112 and 114 and pins 116 and 118. In the illustrated bolt, biasing members 112 and 114 are compression springs, although any other type of biasing member may be used. Bolt 100 is configured and arranged to be received in and carried by a bolt-carrier that is constructed and arranged to be received in and reciprocate in a receiver attached to a barrel as part of a firearm. As a point of reference, bolt 100 is configured for use with a weapon chambered for a 7.62 mm NATO cartridge having a cycle time between approximately 0.060 seconds and approximately 0.100 seconds.

Bolt head 102 includes a plurality of lugs 120, forward face 122, wall 124, bolt face 126, chamfer 128, recess 130, ejector channels 132 and 134, firing pin aperture 136, slot 138, extractor pin channel 140 and ejector pin channels 142 and 144. Lugs 120 are constructed and arranged to be received in a rotating bolt rifle. Lugs 120 pass through corresponding grooves in a barrel or barrel extension and then bolt 100 is rotated to engage lugs 120 with corresponding projections in the barrel or barrel extension (not illustrated) to lock bolt 100 into engagement with the barrel of the firearm. This encapsulates a cartridge in the firing chamber and provides rearward containment when the cartridge is fired. Forward face 122 is the forward portion of bolt head 102 and includes portions of lugs 120. Wall 124 and bolt face 126 define recess 130 in bolt head 102 that is constructed and arranged to receive the base of a cartridge. Wall 124 defines a circular shaped curve that substantially corresponds to the round shape of base 90 of cartridge 80.

Extractor 104 includes projection 150 that is constructed and arranged to interface with a chambered spent casing and to extract that shell casing from the chamber when the bolt moves rearward. In the illustrated embodiment, projection 150 is constructed and arranged to fit within groove 92 and engage rim 93 to extract casing 84 out of the firing chamber. This is further illustrated in FIG. 14.

Ejector channel 132 is constructed and arranged to receive ejector 106 and biasing member 112 that biases ejector 106 to protrude beyond bolt face 126 and to be approximately flush with forward face 122. Ejector 106 is pushed down to be substantially flush with bolt face 126 when a cartridge is received in recess 130. Ejector 106 (with the biasing means) provides a force against the cartridge that promotes ejection of spent cartridges as part of the action of a firearm.

Similarly, ejector channel 134 is constructed and arranged to receive ejector 108 and biasing member 114 that biases ejector 108 that protrudes beyond bolt face 126 to be approximately flush with forward face 122. Ejector 108 is also pushed down to be flush with bolt face 126 when a cartridge is received in recess 130. Ejector 108 (with biasing member 114) also provides a force against the cartridge that promotes ejection of the spent cartridge as part of the action of the firearm. Both ejector 106 and 108 may act in unison to eject spent cartridges, as further explained below.

Firing pin aperture 136 is constructed and arranged to receive firing pin 110 and to allow firing pin 110 to protrude beyond bolt face 126 to strike a primer in the received cartridge as is well known in the art.

Slot 138 is constructed and arranged to receive extractor 104 and to allow projection 150 to move radially away from bolt face 126 and wall 124 when a cartridge is received in recess 130. In this regard, extractor pin channel 140 is constructed and arranged to receive a pin that passes through extractor 104 and about which extractor 104 is constructed and arranged to pivot. While not illustrated, bolt 100 may include a biasing member that biases projection 150 towards bolt face 126 (to move projection 150 into engagement within groove 92).

Ejector pin channels 142 and 144 are constructed and arranged to receive pins 116 and 118. Pins 116 and 118 are constructed and arranged to be received in slots 154 and 156 to retain ejectors 106 and 108 in ejector channels 132 and 134 and further limit the range of motion of ejectors 106 and 108.

Figure 9:
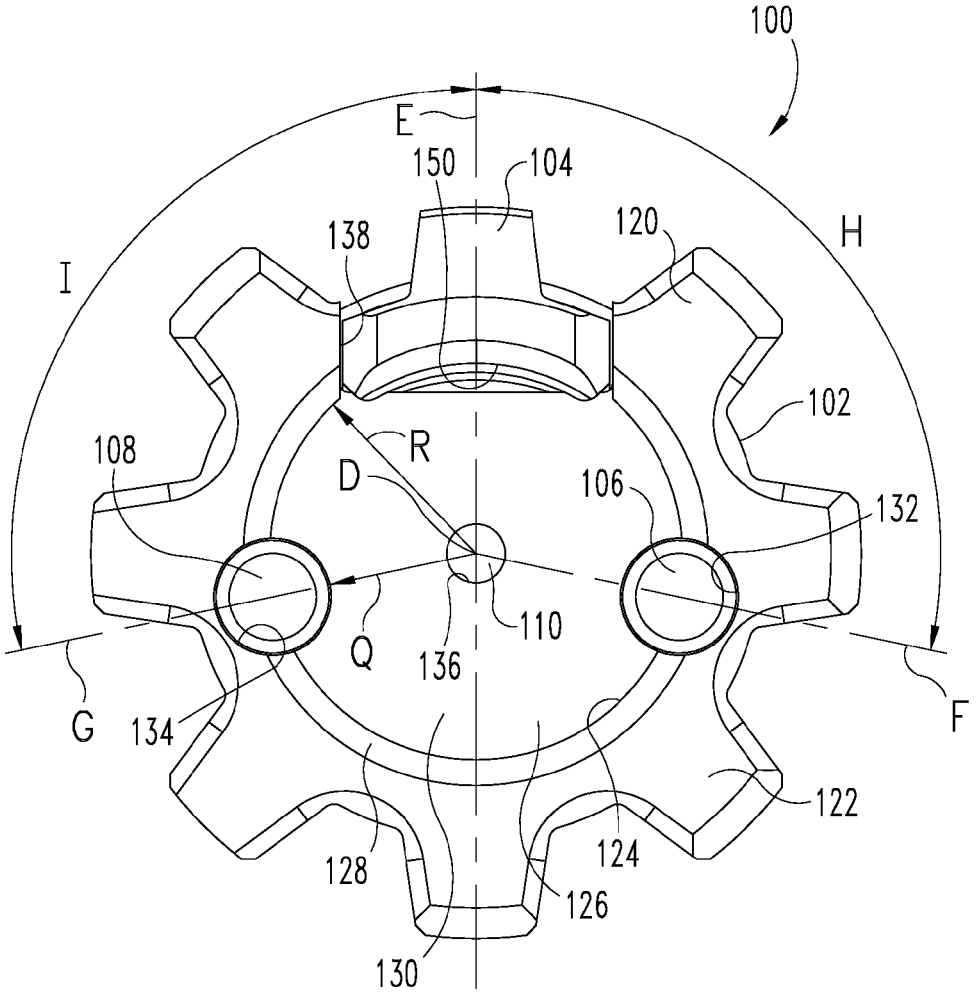
FIG. 9 is a front elevational view of a first inventive bolt relating to applicant's invention.
Figure 10:
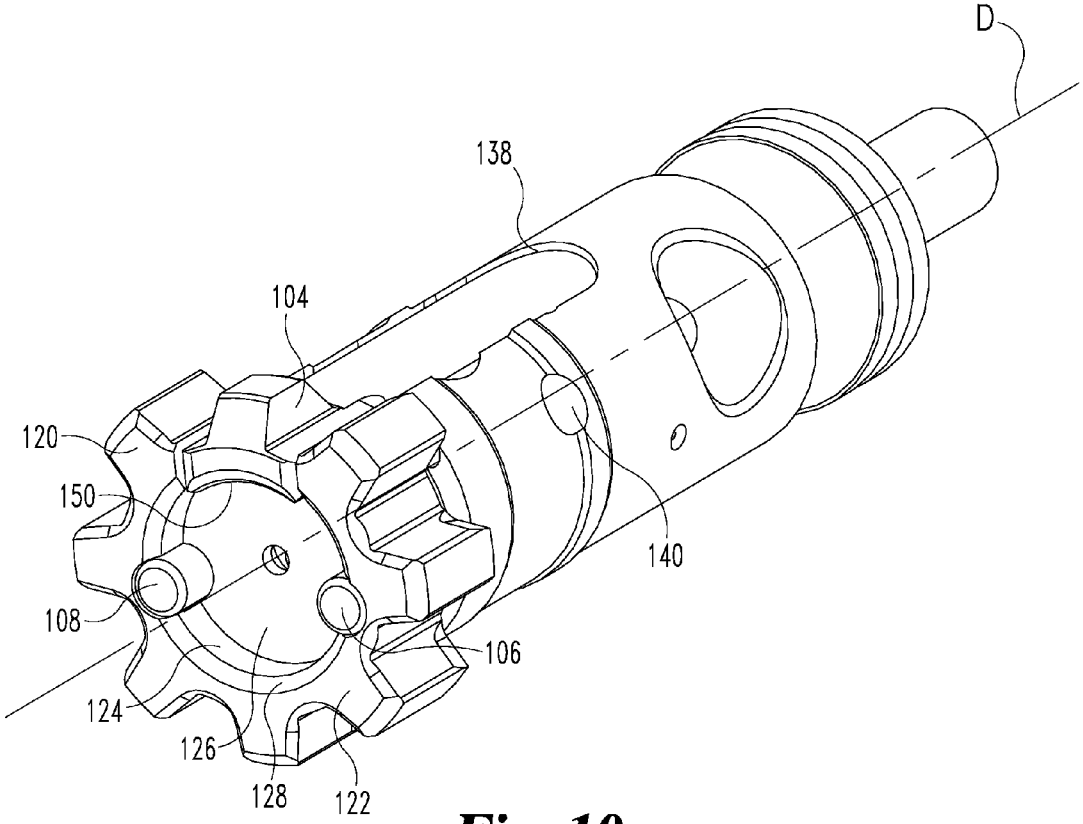
FIG. 10 is a top perspective view of the FIG. 9 bolt.
Figure 11:
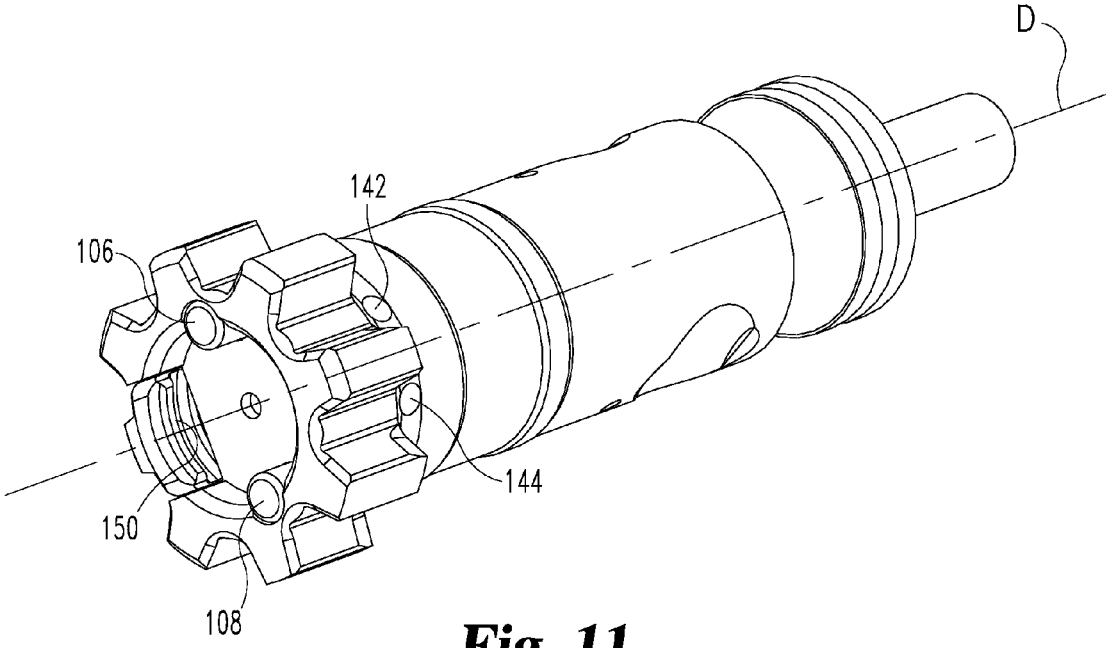
FIG. 11 is a bottom perspective view of the FIG. 9 bolt.
Figure 12:
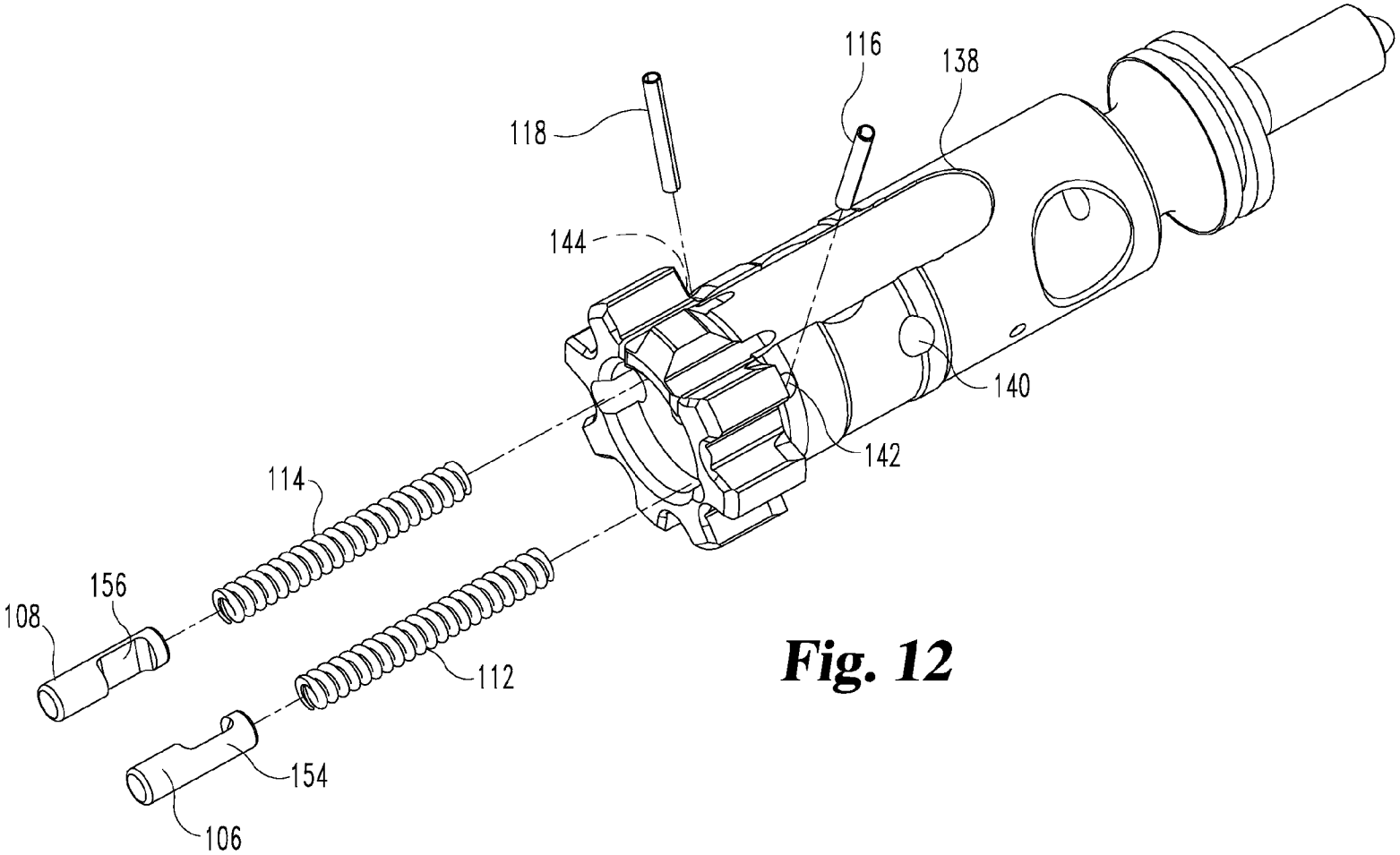
FIG. 12 is a partial exploded assembly view of the FIG. 9 bolt.

Still referring to FIGS. 9-12, bolt 100 defines longitudinal axis D. Referring specifically to FIG. 9, also shows extractor plane E, radial ejector planes F and G and angles H and I. Extractor plane E substantially bisects extractor 104 and longitudinal axis D lies within extractor plane E. Note that channels 132 and 134 and ejectors 106 and 108 lie on opposite sides of extractor plane E.

Radial ejector plane F substantially bisects channel 132 and longitudinal axis D lies within it. Angle H is defined as the angle between radial ejector plane F and extractor plane E and angle I is defined as the angle between radial ejector plane G and extractor plane E. In the embodiment illustrated in FIGS. 9-12, both angles H and I are equal to approximately $5\pi/9$ radians. Other embodiments (not illustrated), the angles H and I can vary between $4\pi/9$ to $6\pi/9$ radians. In yet other embodiments (also not illustrated), angles H and I can vary between $3\pi/9$ to $7\pi/9$ radians.

In the illustrated embodiments, angles H and I are generally equal. However, in other embodiments (not illustrated) angles H and I could be different. Varying the relative angles H and I would vary the trajectory of ejected casings 84. Varying the position of channels 132 and 134 by varying angles H and I could therefore be used to customize the trajectory of ejected casings 84.

Also as illustrated in FIG. 9, radius R is the distance between longitudinal axis D and wall 124 and distance Q is the distance between longitudinal axis D and the closest part of channel 132 or 134. In the illustrated embodiment, distance Q equals approximately 71% of radius R.

Figure 13:
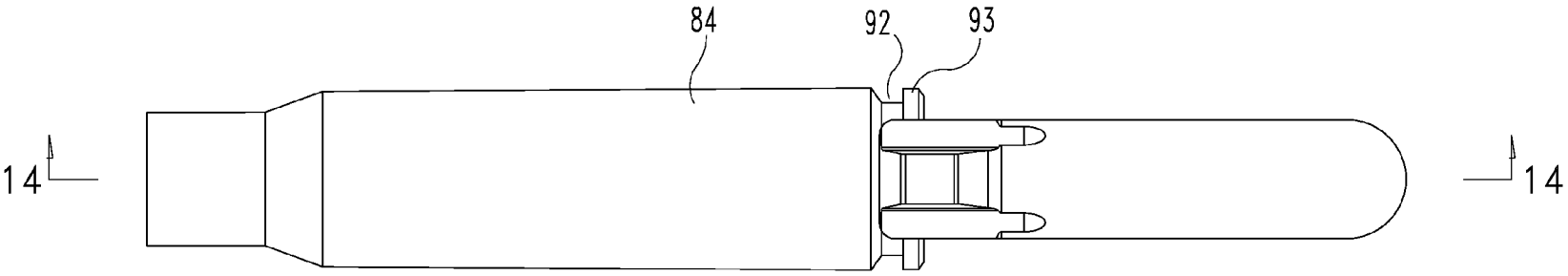
FIG. 13 is a view of an extractor from FIG. 9 engaged with the FIG. 2 casing.
Figure 14:
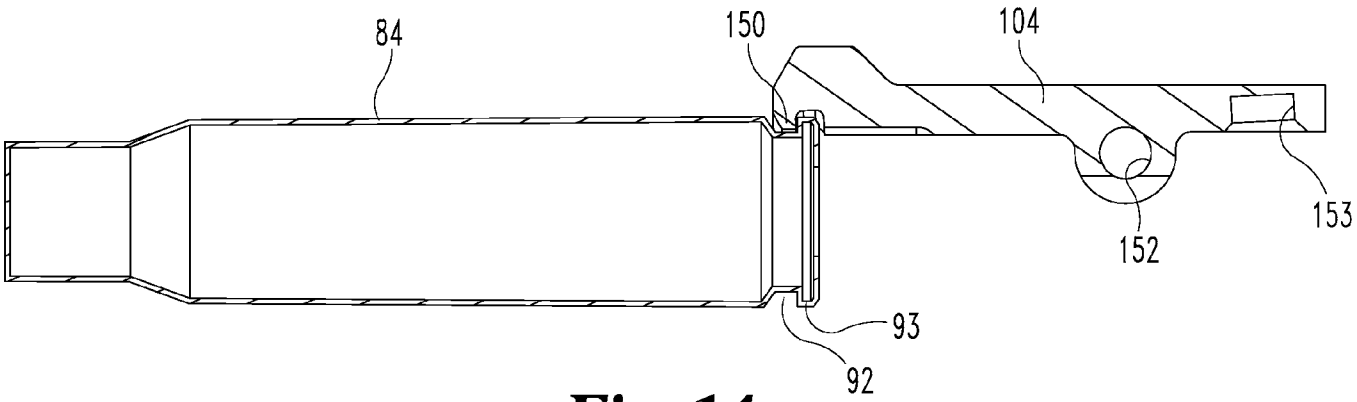
FIG. 14 is a cross-sectional view of FIG. 13 taken along section line 14-14.
Figure 15:
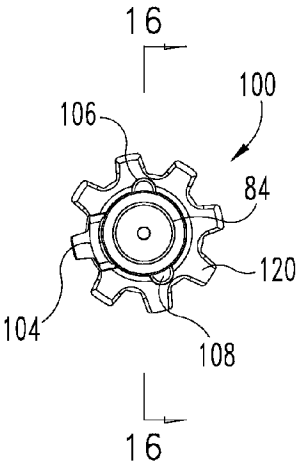
FIG. 15 is an elevational view of the FIG. 9 bolt engaged with the FIG. 2 casing.
Figure 16:
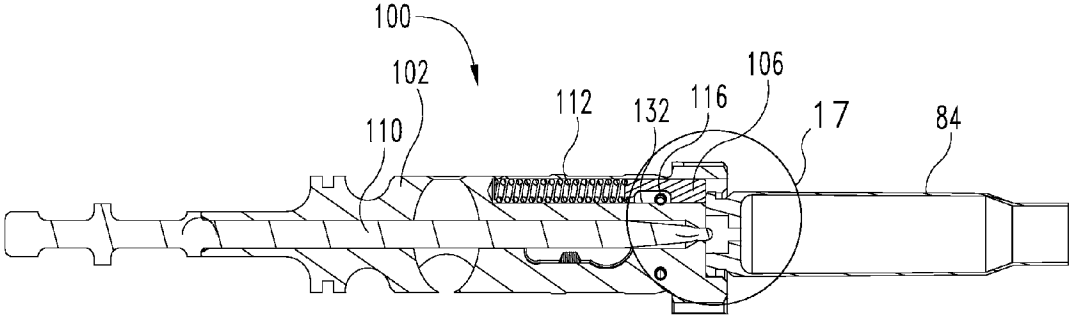
FIG. 16 is a cross-sectional view of the FIG. 15 configuration taken along section line 16-16.

Referring now to FIGS. 13-14, extractor 104 is illustrated engaged with prior art casing 84. As best seen in FIG. 14, extractor 104 includes projection 150, aperture 152 and well 153. Projection 150 is constructed and arranged to fit within groove 92 and engage rim 93 to extract casing 84 out of firing chamber. As described above, aperture 152 is constructed and arranged to receive a pin that extractor 104 can pivot about to move projection 150 to receive new cartridges in the reloading step of the action. A compression spring (not shown) fits in well 153 pressing against bolt head 102 to pivotally bias extractor 104 against prior art casing 84.

Figure 17:
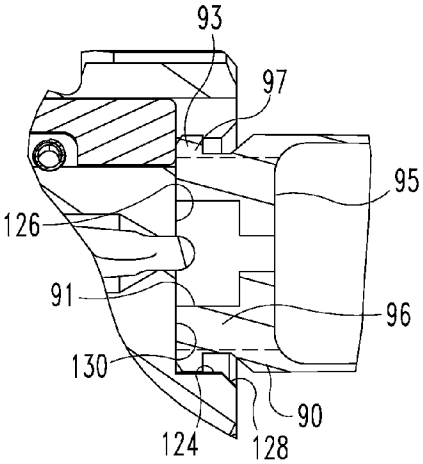
FIG. 17 is a partial cross-sectional view of FIG. 16 taken inside line 17 of FIG. 16.

Referring now to FIGS. 15-18, an engagement between prior art casing 84 and bolt 100 is illustrated. As shown, base 90 is received in recess 130 and abuts against bolt face 126. As best seen in FIG. 17, central portion 96 does not substantially bear against channel 132 (or 134) or ejector 106 (or 108) while peripheral portion does bear against channel 132 (and 134) and ejector 106 (and 108). Applicant has identified that by keeping bolt face 126 substantially smooth and devoid of recesses, such as defined by the space between channels 132 and 134 and ejectors 106 and 108, in the area that central portion 96 bears against bolt face 126, the problem of brass extrusion is minimized or eliminated. The illustrated configuration of bolt head 102 moves channels 132 and 134 and ejectors 106 and 108 radially outside of their traditional position so that they bear primarily against peripheral portion 97.

Figure 20:
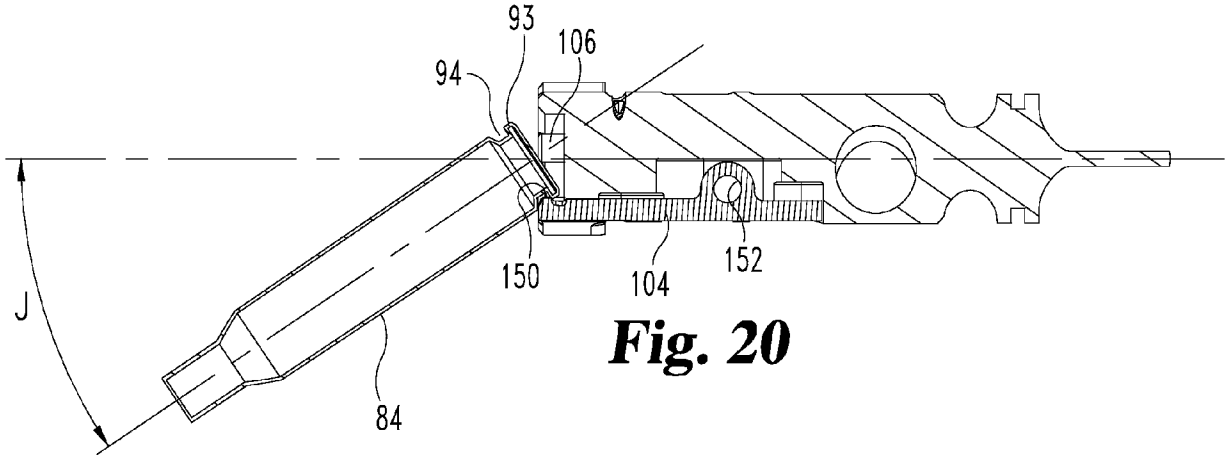
FIG. 20 is a cross-sectional view taken along line 20-20 of FIG. 18.
Figure 18:
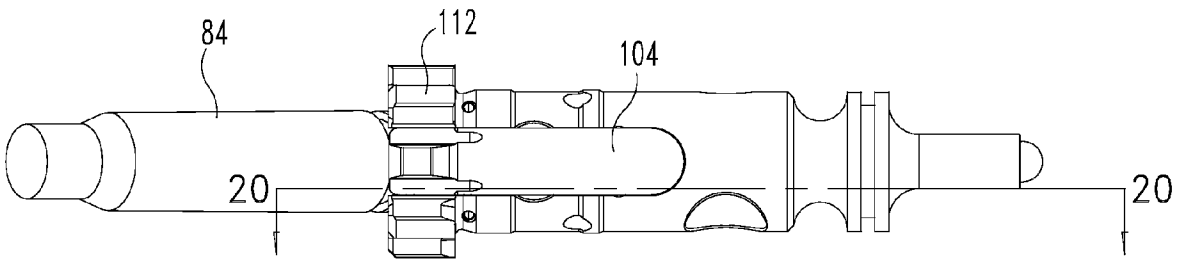
FIG. 18 is a top plan view of the FIG. 9 bolt engaged with the FIG. 2 casing during ejection.
Figure 19:
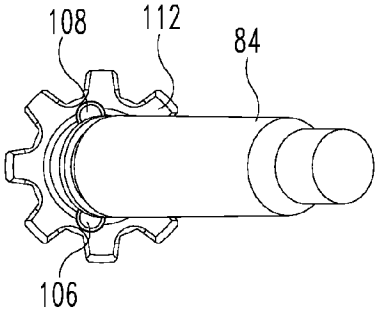
FIG. 19 is a front elevational view of FIG. 18 configuration.

Referring now to FIGS. 18-20, bolt 100 is illustrated with casing 84 during an extraction sequence. In particular, these Figures illustrate in the condition where bolt 100 has moved rearward in the action of the weapon sufficiently that casing 84 clears the chamber and ejectors 106 and 108 have extended to their forward position substantially flush with forward face 122 causing casing 84 to rotate about projection 150. In the illustrated configuration, angle J is equal to approximately 34 degrees. The process of moving ejectors 106 and 108 forward imparts angular momentum combined with moving casing 84 rearwardly results in casing 84 continuing to rotate about projection 150 and eventually leaving the firing chamber making room for a subsequent round to be loaded in the action in the return stroke of bolt 100.

In the illustrated configuration, bolt 100 is able to impart a substantially greater degree of angular rotation of casing 84 before casing 84 leaves contact with ejectors 106 and 108 as compared to prior art bolt 50. Ejectors 106 and 108 engage base 90 substantially closer to projection 150 and thus are able to impart a greater degree of rotation to casing 84 prior to reaching the end of their effective stroke length (at the forward face 122). Furthermore, two ejectors are utilized instead of one ejector allowing greater biasing force to be stored in two biasing members 112 and 114 as opposed to a single biasing member in prior art bolt 50. Applicant has found this combination also may impart greater angular momentum to casing 84 that ejects casing 84 more rapidly from the action of the firearm as compared to the configuration illustrated in bolt 50. This configuration may also provide some redundancy to bolt 100, as failure of one ejector would not necessarily result in the failure of the system as the other ejector could still provide for the ejection of the shell casing.

Figure 21:
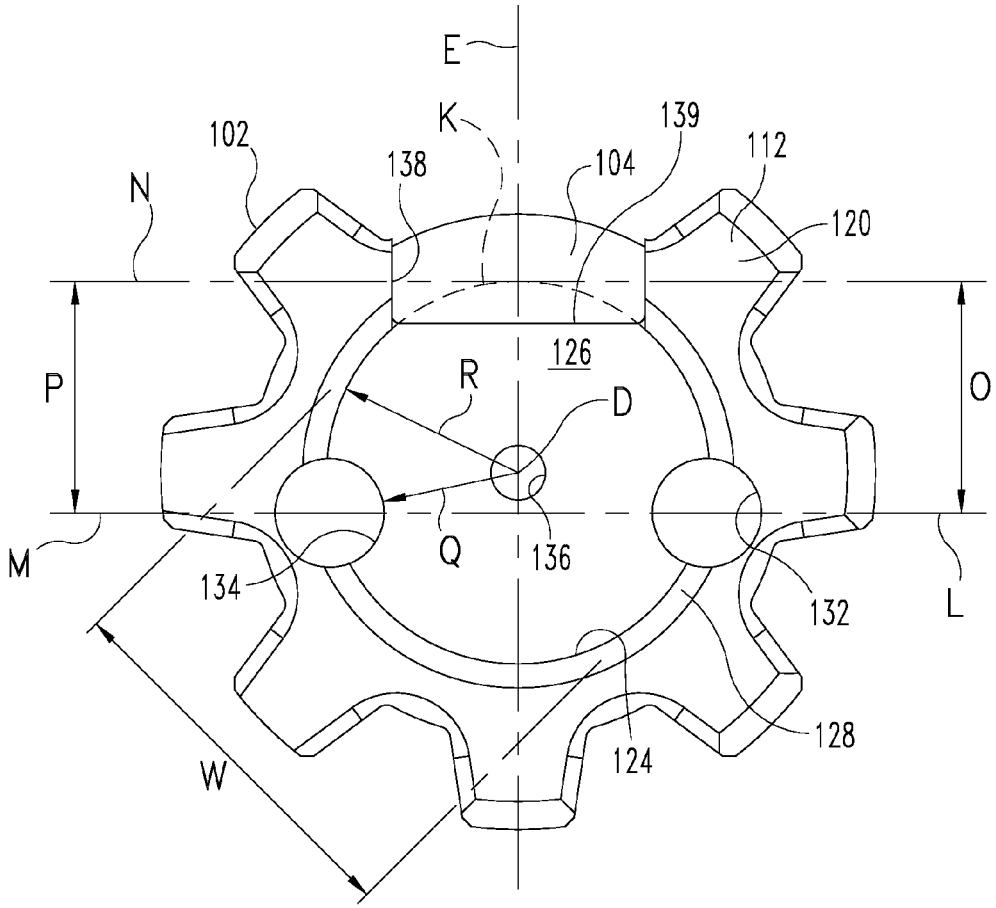
FIG. 21 is a front elevational view of the FIG. 9 bolt illustrating an alternative coordinate system.
Figure 22:
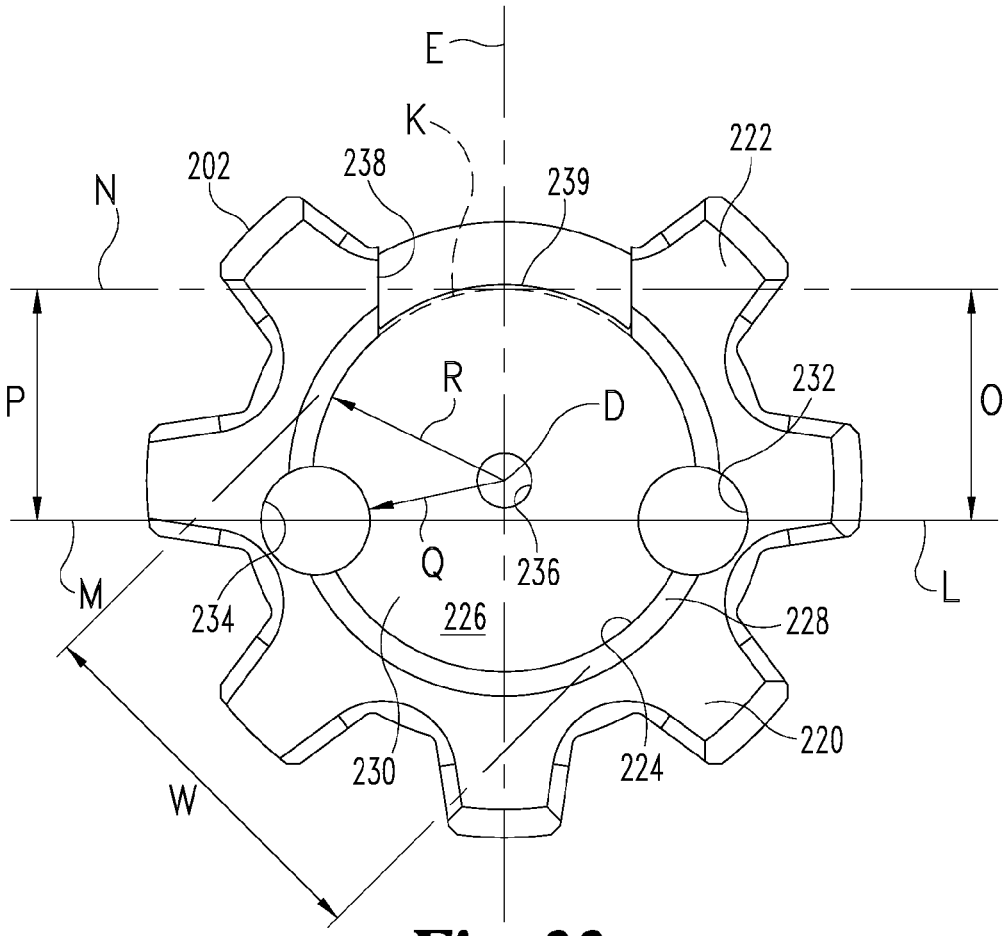
FIG. 22 is a front elevational view of a second inventive bolt.

Referring now to FIG. 21, bolt head 102 is illustrated with an alternate reference system to define the locations of channels 132 and 134 with respect to bolt face 126. Also, FIG. 21 illustrates bolt head 102 without extractor 104 or ejectors 106 or 108. As shown in FIG. 21, slot 138 includes relief 139 and bolt face 126. Relief 139 may optionally be included to provide space for extractor 104 to operate. However as shown in FIG. 22 (described below) relief 139 may be omitted or replaced with other shapes as desired.

The coordinate systems illustrated in FIG. 21 includes extractor plane E, normal ejector plane L, normal ejector plane M, and wall plane N. Extractor plane E substantially bisects slot 138 and longitudinal axis D lies within extractor plane E. Ejector plane L is normal to extractor plane E and substantially bisects channel 132. Normal ejector plane M is also normal to extractor plane E and substantially bisects channel 134. In this embodiment, normal ejector plane L is coincident with normal ejector plane M, but in other embodiments they may be offset from each other. Wall plane N is tangent to imaginary circle K corresponding to the circular shape defined by the periphery of bolt face 126. Wall plane N is also normal to extractor plane E.

Distance O is the distance between normal extractor plane L and wall plane N. Distance P is the distance between normal ejector plane M and wall plane N. Distances O and P are both expressed as a percentage of width W with width W representing the width of bolt face 126. In the illustrated embodiment, distances O and P are substantially equal and are both equal to approximately 60% of width W. In other embodiments, distances O and P can vary between approximately 45% and approximately 75% of width W. In yet other embodiments, distances O and P can vary between approximately 50% to approximately 70% of width W. Yet in other embodiments, distances O and P can vary between approximately 55% and 65% of width W.

FIG. 21 also illustrates circle K. Circle K is an imaginary expansion of wall 124 that defines a curve that substantially corresponds to the circular shape defined by the periphery of bolt face 126. Note that, in the illustrated embodiment, a majority of channels 132 and 134 are positioned radially outside of circle K.

Referring now to FIG. 22, a second inventive bolt head 202 is illustrated. Bolt head 202 is an alternative embodiment of bolt head 102. Bolt head 202 includes arched extension 239 instead of relief 139. Arched extension 239 gives bolt face 226 a substantially circular periphery that is slightly larger than the periphery of base 90. While not illustrated in FIG. 22, bolt head 202 requires use of a modified extractor that includes an appropriate relief (not illustrated) to not adversely interface with arched extension 239. Otherwise, bolt head 202 includes lugs 220, forward face 222, wall 224, bolt face 226, chamfer 228, recess 230, channels 232 and 234, aperture 236.

Lugs 220 are constructed and arranged to be received in a rotating bolt rifle with lugs 220 passing through corresponding grooves in a barrel or barrel extension that bolt head 202 can be rotated into to engage lugs 220 with corresponding projections in the barrel or barrel extension (not illustrated) to lock bolt head 202 into engagement with the barrel of the firearm.

Channel 232 is constructed and arranged to receive an ejector and biasing member. Similarly, channel 234 is also constructed and arranged to receive an ejector and biasing member. Aperture 236 is constructed and arranged to receive a firing pin and to allow that firing pin to protrude beyond bolt face 226. Slot 238 is constructed and arranged to receive an extractor.

Recess 230 is defined by wall 224 and bolt face 226. Recess 230 is constructed and arranged to receive base 90 of cartridge 80 as illustrated in other embodiments elsewhere. Chamfer 228 is a transition between bolt face 226 and wall 224. Chamfer 228 may include an angular chamfer or radiused transition as desired.

Also as illustrated in FIG. 22, radius R is the distance between longitudinal axis D and wall 224 and distance Q is the distance between longitudinal axis D and the closest part of channel 232 or 234. In the illustrated embodiment, distance Q equals approximately 73% of radius R.

Figure 23:
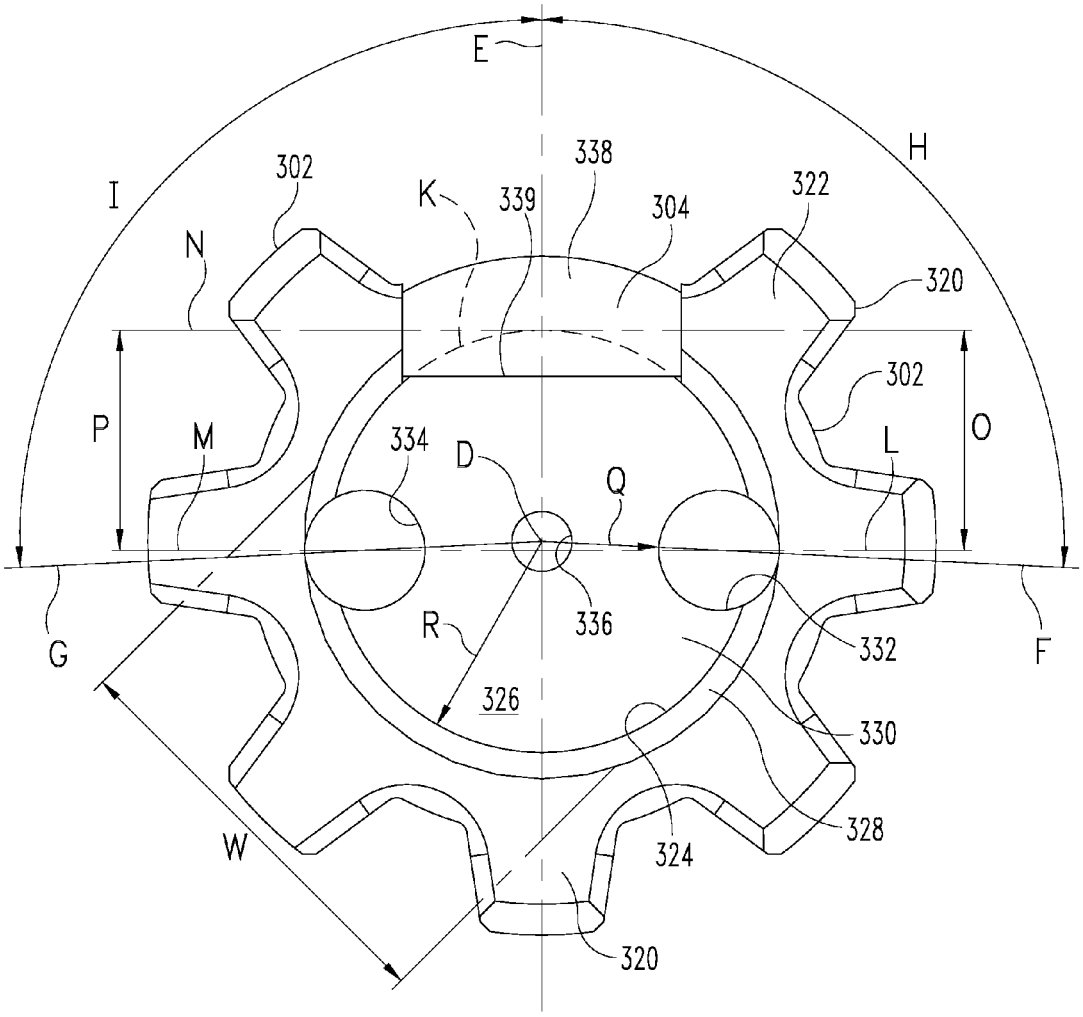
FIG. 23 is a front elevational view of a third inventive bolt.

Referring now to FIG. 23, a third inventive bolt head 302 is illustrated. Bolt head 302 is an alternate embodiment of a bolt head. Bolt head 302 includes lugs 320, forward face 322, wall 324, bolt face 326, chamfer 328, recess 330, channels 332 and 334, aperture 336 and relief 339. As shown in FIG. 23, channels 332 and 334 extend into wall 324 to approximately the extent of chamfer 328.

Lugs 320 are constructed and arranged to be received in a rotating bolt rifle with lugs 320 passing through corresponding grooves and barrels or barrel extensions. The bolt head 302 can be rotated into to engage lugs 320 with corresponding projections the barrel or barrel extensions (not illustrated) to lock bolt head 302 in engagement with barrel of the firearm.

Recess 330 is defined by wall 324 and bolt face 326. Recess 330 is constructed and arranged to receive base 90 of cartridge 80 as illustrated with regard to other embodiments. Chamfer 328 represents a transition between forward face 322 and wall 324. Chamfer 328 may include a radius or angled transition as desired.

FIG. 23 includes the reference systems described in FIGS. 9 and 22 including longitudinal axis D, extractor plane E, extractor plane F, extractor plane G, angle H, angle I, circle K, ejector plane L, ejector plane M, plane N, distance O, distance P, width W, radius R and distance D. In the illustrated embodiment, angles H and I are both equal to approximately $19\pi/36$ radians. Distances O and P both equal to approximately 52% of width W and distance Q equals approximately 56% of radius R.

Distance Q being equal to approximately 56% of radius R is comparable to the radial location of ejector channels in some prior art designs where the problem of brass extrusion has been observed in the M16 class of firearms. Thus bolt head 302 does not exhibit the characteristic of locating channels 332 and 334 outside of central portion 96. Bolt head 302 does illustrate alternative positioning for channels 332 and 334 that would position the ejectors to provide a greater degree of angular pivoting while in direct contact between the ejectors, extractor and base 90 similar to what is shown in FIGS. 18-20 with regard to bolt 100.

Figure 24:
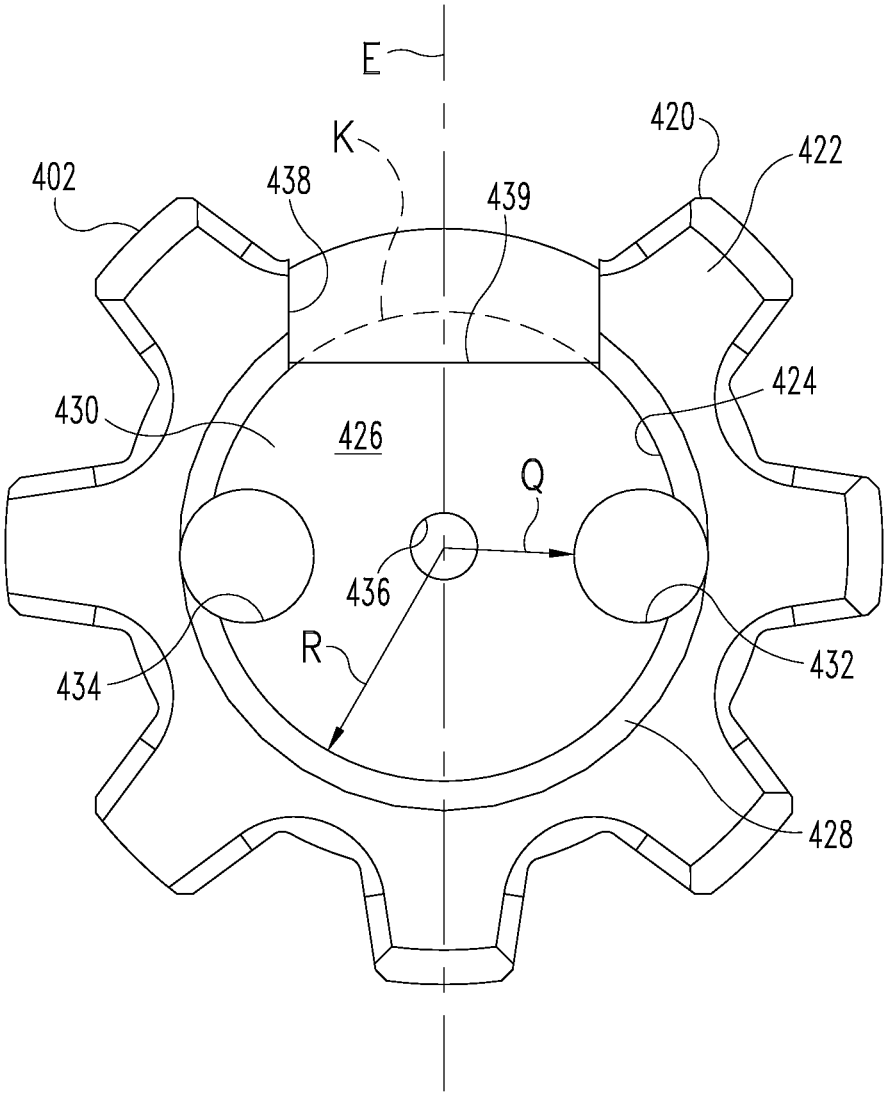
FIG. 24 is a front elevational view of a fourth inventive bolt.

Referring now to FIG. 24, a fourth inventive bolt head 402 is illustrated. Bolt head 402 is an alternate embodiment of a bolt head. Bolt head 402 includes lugs 420, forward face 422, wall 424, bolt face 426, chamfer 428, recess 430, channels 432 and 434 and aperture 436.

Lugs 420 are constructed and arranged to be received in a rotating bolt rifle with lugs 420 passing through corresponding grooves in a barrel or barrel extension. Bolt head 402 can be rotated to engage lugs 420 with corresponding projections in the barrel or barrel extension (not illustrated) to lock bolt head 402 into engagement with the barrel of a firearm.

Forward face 422 represents the forward most portion of bolt head 402 and includes portions of lugs 420. Wall 424 and bolt face 426 define recess 430 which is constructed and arranged to receive base 90 of cartridge 80. Chamfer 428 transitions between wall 424 and forward face 422 and may be angled or radiused as desired. Channels 432 and 434 are constructed and arranged to receive ejectors and biasing members. Aperture 436 is constructed and arranged to receive a firing pin. Slot 438 and relief 439 are constructed and arranged to receive an extractor.

Referring to FIG. 24, the coordinate system described in FIGS. 9 and 21 are not included in FIG. 24, but as a point of reference, angles H and I are both equal to approximately $\pi/2$ radians and distances O and P are both equal to approximately 50% of the width of bolt face 426 and distance Q equals approximately 42% of radius R.

Once again, the embodiment illustrated in FIG. 24 does not include the feature of positioning channels 432 and 434 outside of central portion 96 of cartridge 80. In this regard, channels 432 and 434 are substantially contained in bolt face 426 and do not extend into wall 424. Bolt head 402 does position the ejectors to provide a greater degree of angular pivoting while in direct contact with the ejectors, similar to what is illustrated in FIGS. 18-20 with regard to bolt 100.

Figure 25:
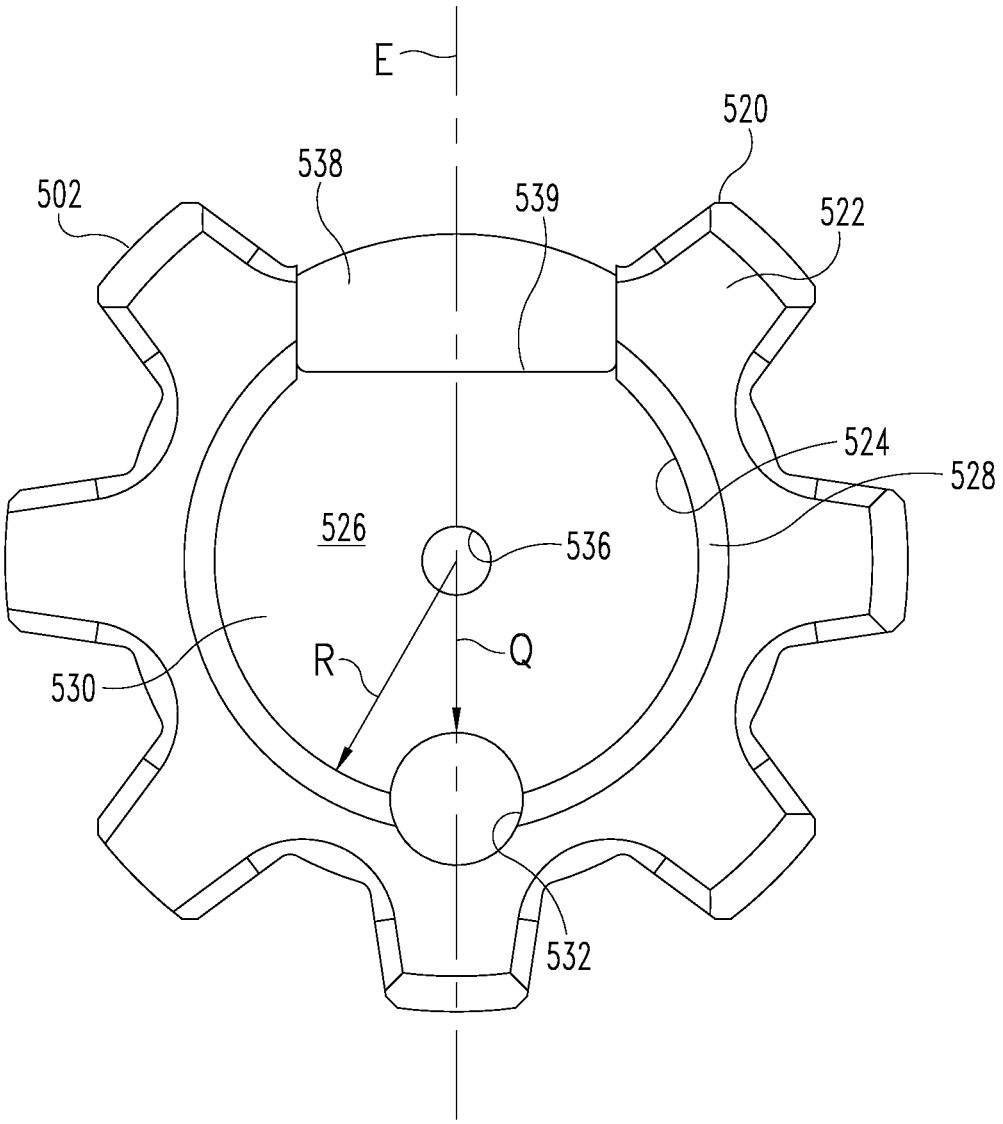
FIG. 25 is a front elevational view of a fifth inventive bolt.

Referring now to FIG. 25, a fifth inventive bolt head 502 is illustrated. Bolt head 502 represents an alternate embodiment of a bolt head according to the present disclosure. Bolt head 502 includes lugs 520, forward face 522, wall 524, bolt face 526, chamfer 528, recess 530, channel 532, aperture 536, slot 538 and relief 539.

Lugs 520 are constructed and arranged to be received in a rotating bolt rifle with lugs 520 passing through corresponding grooves in a barrel or barrel extension that bolt head 502 can be rotated into to engage lugs 520 with corresponding projections in the barrel or barrel extension (not illustrated) to lock bolt head 502 into engagement with the barrel of the firearm.

Forward face 522 defines the forward most portion of bolt head 502. Wall 524 and bolt face 526 define recess 530 constructed and arranged to receive base 90 of cartridge 80. Chamfer 528 represents the transition between forward face 522 and wall 524 and may be radiused or angled as desired.

As shown, bolt head 502 includes a single channel 532 constructed and arranged to receive a single ejector and biasing member. Channel 532 is located radially outward compared to channel 72 in bolt 50 such that distance Q equals approximately 70% of radius R with channel 532 lying substantially outside of wall 524.

Figure 26:
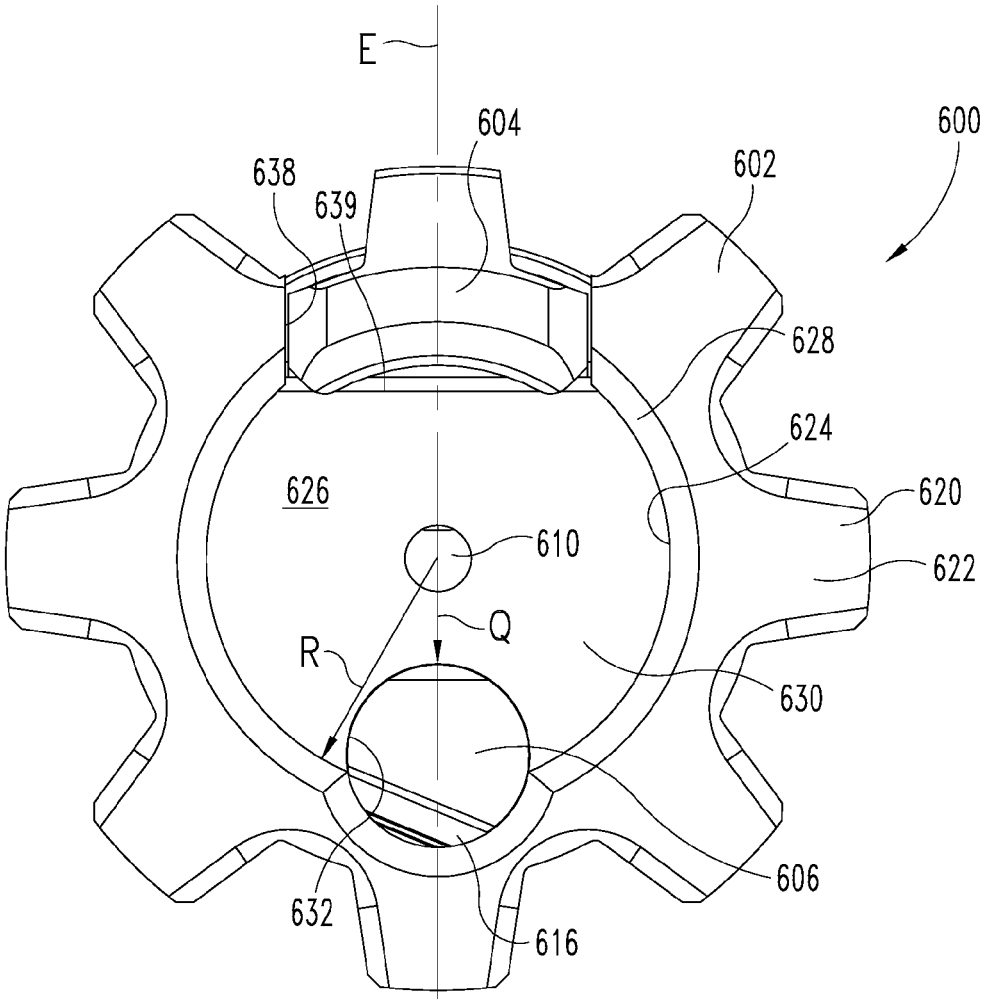
Fig. 26 (PRIOR ART)
FIG. 26 is a front elevational view of a second prior art bolt.
Figure 28:
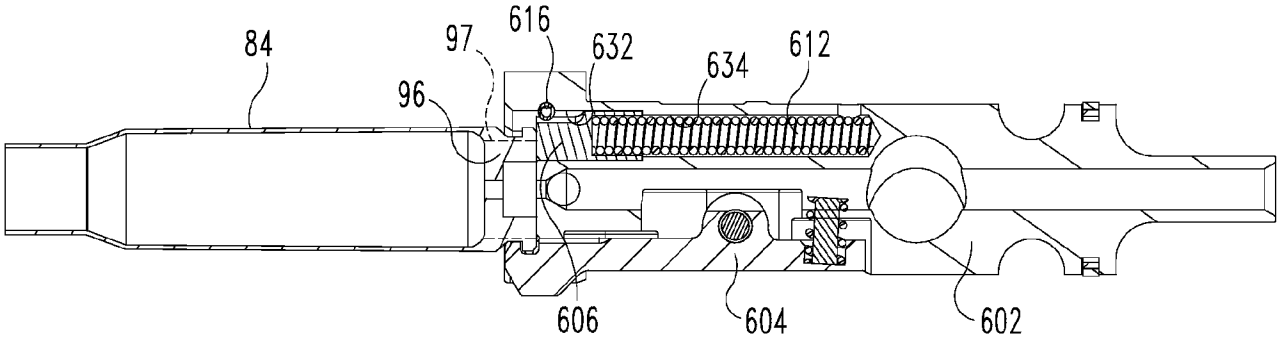
Fig. 28 (PRIOR ART)
FIG. 28 is a cross sectional view of FIG. 27 taken along line 28-28.
Figure 27:
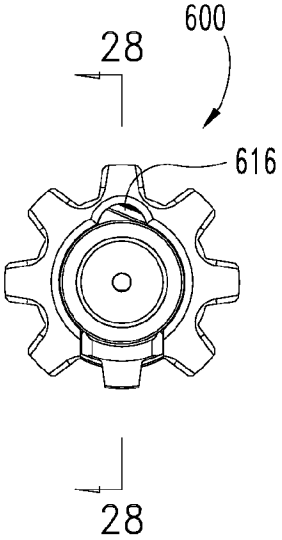
Fig. 27 (PRIOR ART)
FIG. 27 is a front elevational view of the FIG. 26 bolt engaging the FIG. 2 casing.

Referring to FIGS. 26-28, a second prior art bolt 600 is illustrated for comparative purposes. Prior art bolt 600 is a scale illustration of a KAC SR-25. Bolt 600 includes bolt head 602, extractor 604, ejector 606, firing pin 610, biasing member 612 and pin 616. Bolt head 602 includes a plurality of lugs 620, forward face 622, wall 624, bolt face 626, chamfer 628, recess 630, channel 632, slot 638, and channel 632.

One difference between bolt 600 as shown in FIG. 26 and bolt 50 as shown in FIG. 1 is the substantially larger diameter ejector 606 (compared to ejector 56). Because ejector 606 is significantly larger than ejector 56, channel 632 extends into wall 624 to a greater degree than channel 72 does. However, this modification does not move ejector 606 out of contact with central portion 96 of casing 84. To the contrary, as illustrated in FIG. 28, ejector 606 contacts both central portion 96 and peripheral portion 97. As a point of reference, for bolt 600, distance Q equals approximately 45% of radius R.

Applying the feature of positioning ejectors and ejector channels outside of the central portion of a cartridge to other types of firearms is dependent on the configuration of the cartridge used by a particular firearm and the forces experienced by the cartridge when fired in the particular firearm. Furthermore, the pressure exerted on base 90 generally varies radially, so it can be difficult to identify the boundary between central portion 96 and peripheral portion 97. Applicants have identified that in many cases, a distance Q of at least seventy percent of the radius of the bolt face is adequate to minimize the problem of brass extrusion. In other cases, a distance Q of at least sixty five percent of the radius of the bolt face is adequate to minimize the problem of brass extrusion. In yet other cases, a distance Q of at least sixty percent of the radius of the bolt face is adequate to minimize the problem of brass extrusion.

Figure 29:
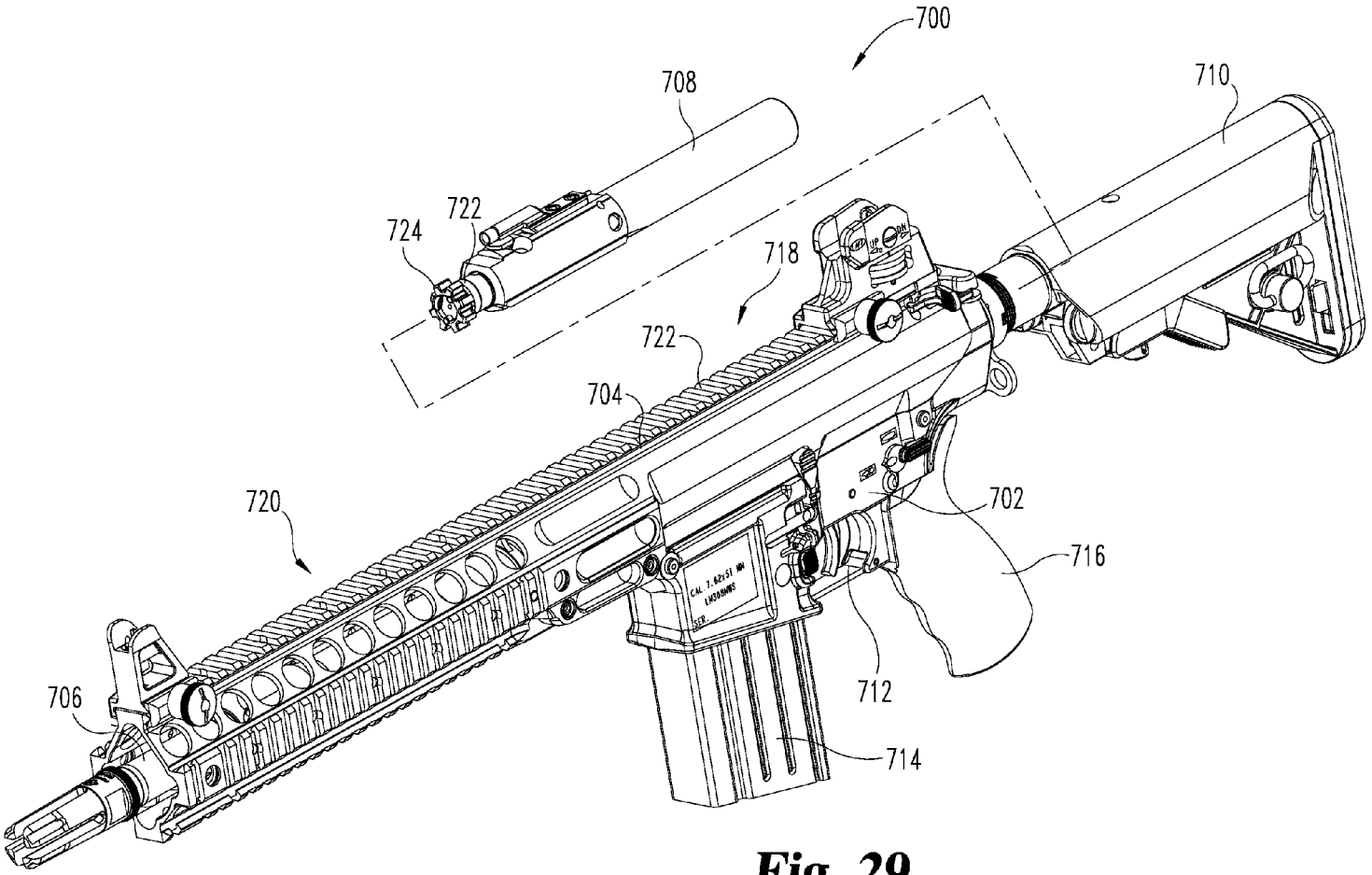
FIG. 29 is a perspective assembly view of a rifle incorporating the inventive bolt.

Referring to FIG. 29 rifle 700 is illustrated. Rifle 700 is configured for use with 7.62 mm×51 mm NATO rounds and is based on the AR/10® design. The illustrated rifle is manufactured by Lewis Machine & Tool Co. in Milan, Ill. Rifle 700 includes lower receiver 702, integral upper receiver and hand guard 704, barrel assembly 706 and bolt carrier 708. Lower receiver 702 includes stock 710, trigger assembly 712, magazine 714 and handle 716.

Integral upper receiver and hand guard 704 includes upper receiver portion 718 and hand guard portion 720. Upper rail 722 extends across upper receiver portion 718 and hand guard portion 720. In the illustrated embodiment integral upper receiver and hand guard 704 is unitarily constructed of a single piece. However in other embodiments, integral upper receiver and hand guard 704 may be constructed from a plurality of pieces joined together. In yet other embodiments, integral upper receiver and hand guard 704 may be replaced with a conventional upper receiver and detachable hand guard portion as is well known in the art.

Bolt carrier 708 includes bolt assembly 722 incorporating bolt 724. Bolt 724 corresponds to one of the bolts or bolt heads disclosed herein including bolt 100 or bolt heads 202, 302, 402 or 502.

Figure 30:
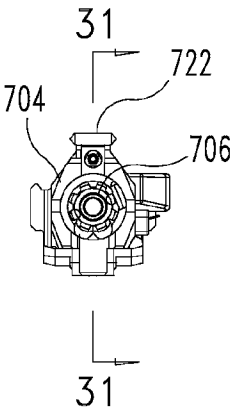
FIG. 30 is a side elevation view of a upper receiver/barrel assembly of the FIG. 29 rifle.

Referring to FIG. 30 an end view of an assembly including integral upper receiver and hand guard 704 and barrel assembly 706 is shown.

Figure 31:
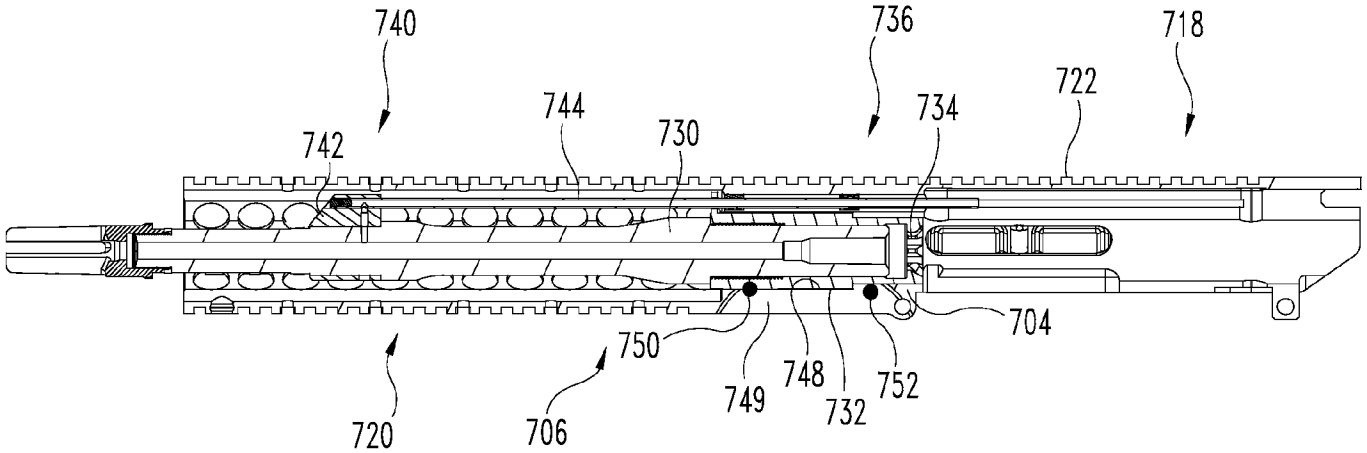
FIG. 31 is a cross-sectional view taken along line 31-31 of FIG. 30.

Referring to FIG. 31 a cross sectional view taken along line 31-31 of FIG. 30 is illustrated including integral upper receiver and hand guard 704 and barrel assembly 706. As shown in FIG. 31, barrel assembly 706 includes barrel portion 730 and barrel extension 732 connected together by a threaded coupling. Barrel extension 732 includes lugs 734 and chamber 736. Lugs 734 are configured to interface with the bolt lugs described above including lugs 120, 122, 222, 320 and 420 and 520 to lock the bolt in barrel extension 722 during firing. Chamber 736 is configured to receive a 7.62 mm×51 mm cartridge. Barrel 730 includes gas port 740 which is fluidly connected to gas block 742 and gas tube 744 to port combustion gases back to upper receiver portion 718 to unload and reload rifle 700 as is well known in the art.

Barrel assembly 706 is coupled to integral upper receiver and hand guard 704 by a clamp coupling between bore 748 in integral upper receiver hand guard 704 and barrel extension 732. In this regard, integral upper receiver and hand guard 704 includes slot 749 below bore 748. In addition, bore 748 is only slightly larger than the outer diameter of barrel extension 732. Fasteners 750 and 752 clamp opposing sides of integral upper receiver and hand guards 704 together across slot 742 to clamp integral upper receiver hand guard 704 about barrel extension 732. In addition, fastener 750 passes through a portion of barrel extension 732 to provide a locking feature in the event that clamping forces is inadequate to secure barrel assembly 706 in integral upper receiver hand guard 704.

Figure 32:
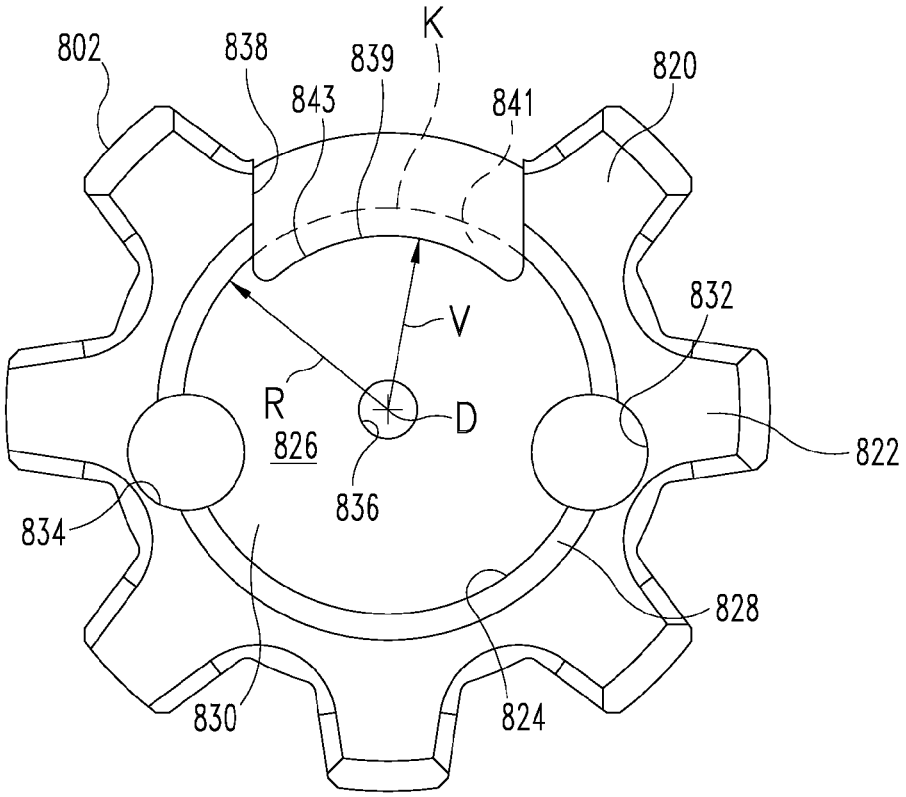
FIG. 32 is a front elevational view of a sixth inventive bolt.

Referring now to FIG. 32, a sixth inventive bolt head 802 is illustrated. Bolt head 802 is an alternative embodiment of bolt head 102. Bolt head 802 includes arched extension 839 instead of relief 139 (or arched extension 239). Otherwise, bolt head 802 includes lugs 820, forward face 822, wall 824, bolt face 826, chamfer 828, recess 830, channels 832 and 834, aperture 836.

Lugs 820 are constructed and arranged to be received in a rotating bolt rifle with lugs 820 passing through corresponding grooves in a barrel or barrel extension that bolt head 802 can be rotated into to engage lugs 820 with corresponding projections in the barrel or barrel extension (not illustrated) to lock bolt head 802 into engagement with the barrel of the firearm.

Channel 832 is constructed and arranged to receive an ejector and biasing member. Similarly, channel 834 is also constructed and arranged to receive an ejector and biasing member. Aperture 836 is constructed and arranged to receive a firing pin and to allow that firing pin to protrude beyond bolt face 826. Slot 838 is constructed and arranged to receive an extractor.

Recess 830 is defined by wall 824 and bolt face 826. Recess 830 is constructed and arranged to receive base 90 of cartridge 80 as illustrated in other embodiments elsewhere. Chamfer 828 is a transition between bolt face 826 and wall 824. Chamfer 828 may include an angular chamfer or a radiused transition as desired.

Also as illustrated in FIG. 32, radius R is the distance between longitudinal axis D and wall 824. Radius V is the distance between longitudinal axis D and the outer periphery of arched extension 839. Radius V may also define the radius of outer periphery 843 of arched extension 839. Circle K is an imaginary expansion of wall 824 that defines a curve that substantially corresponds to the circular shape defined by the periphery of bolt face 826.

All portions of bolt fact 826 on arched extension 839 are located inside of circle K. The space between circle K and arched extension 839 defines undercut 841. Similar to embodiments described above, bolt head 802 requires use of a modified extractor that includes an appropriate relief (not illustrated) to not adversely interface with arched extension 839. The required relief in the modified extractor for use with bolt 802 is less than the modification required with other embodiments, e.g., bolt 202.

Radius V may be substantially equal to radius U (the outer radius of the bottom surface of groove 92 of cartridge 80). Radius V may be constructed and arranged such that bolt face 826 covers substantially all of central portion 96 of cartridge 80 while leaving the portion of peripheral portion 97 in slot 838 substantially uncovered. Radius V may be customized to match the circular profile of the inner surface of groove 92 of the particular cartridge 80 that bolt 802 is intended to be used with. Radius V is less than the radius of wall 824.

While the disclosure has been illustrated and described in detail in the drawings and foregoing description, the same is to be considered as illustrative and not restrictive in character, it being understood that only certain specific embodiments have been shown and that all changes and modifications that come within the spirit of the disclosure are desired to be protected.

I claim:

1. An apparatus, comprising:

a bolt assembly comprising: a bolt head, a bolt face, an extractor and a first and second ejector, wherein the bolt head defines a first and second channel that receive the first and second ejectors, wherein the bolt head defines a longitudinal axis, an extractor plane and a first and second radial ejector plane, wherein the extractor plane substantially bisects the extractor, wherein the first ejector plane substantially bisects the first channel, wherein the second ejector plane substantially bisects the second channel and wherein the longitudinal axis lies on each of the extractor plane and the first and second ejector plane;

wherein the first and second channels are positioned on opposite sides of the extractor plane;

wherein a first angle between the extractor plane and the first radial ejector plane is between approximately $3\pi/9$ and $7\pi/9$ radians;

wherein a second angle between the extractor plane and the second radial ejector plane is between approximately $3\pi/9$ and $7\pi/9$ radians; and wherein the extractor is constructed and arranged to interface with a shell casing in a chamber and to extract the shell casing from the chamber and wherein the first and second ejectors are constructed and arranged to push the shell casing away from the bolt face thereby pivoting the shell casing substantially about the extractor.

2. The apparatus of claim 1, wherein the extractor is constructed and arranged to interface with a rim on the shell casing.

3. The apparatus of claim 2, wherein the extractor comprises a projection constructed and arranged to interface with the rim, wherein the projection is constructed and arranged to position a rim on the shell casing between the projection and the bolt face.

4. The apparatus of claim 1, wherein the first and second ejectors are substantially cylindrically-shaped.

5. The apparatus of claim 1, wherein the first and second ejectors are biased from within the first and second channels to protrude out of the bolt face.

6. The apparatus of claim 1, wherein the first and second angles are between approximately $4\pi/9$ and $6\pi/9$ radians.

7. The apparatus of claim 1, wherein the first and second angles are between approximately $3\pi/9$ and $\pi/2$ radians.

8. The apparatus of claim 1, wherein the first and second angles are substantially equal.

9. The apparatus of claim 1, wherein the first and second angles are substantially equal to $5\pi/9$ radians.

10. The apparatus of claim 1, wherein the bolt assembly further comprises a wall that substantially circumscribes the bolt face defining a recess constructed and arranged to receive the shell casing, wherein the first and second channels intersect a curve substantially circumscribing the wall whereby substantial portions of the first and second channels are positioned radially outside of the curve.

11. The apparatus of claim 10, wherein a majority of the first and second channels are positioned radially outside of the curve.

12. The apparatus of claim 10, wherein the first and second channels are constructed and arranged so that the first and second ejectors primarily bear against an peripheral portion of the shell casing.

13. The apparatus of claim 10, wherein a distance between the longitudinal axis and the first channel is at least sixty percent of a radius between the longitudinal axis and the wall.

14. The apparatus of claim 10, wherein the bolt head defines an arched extension to the bolt face that extends under the extractor, wherein the arched extension defines a radius less than a radius of the wall.

15. An apparatus, comprising:

a bolt assembly comprising a bolt head, a bolt face, a wall, an extractor and a first and second ejector, wherein the bolt head defines a first and second channel that receive the first and second ejectors, wherein the wall substantially circumscribes the bolt face defining a recess constructed and arranged to receive a shell casing, wherein the bolt head defines a longitudinal axis, an extractor plane, a wall plane, a first normal ejector plane and a second normal ejector plane; wherein the longitudinal axis lies on the extractor plane and the extractor plane substantially bisects the extractor, wherein the wall plane is normal to the extractor plane and is substantially tangent to a circle approximating the wall, wherein the first normal ejector plane is normal to the extractor plane and substantially bisects the first channel and wherein the second normal ejector plane is normal to the extractor plane and substantially bisects the second channel;

wherein the first and second channels pass through the bolt face and are positioned on opposite sides of the extractor plane;

wherein a first distance between the wall plane and the first normal ejector plane is equal to approximately 45% to 75% of a width of the bolt face;

wherein a second distance between the wall plane and the second normal ejector plane is equal to approximately 45% to 75% of the width of the bolt face; and wherein the extractor is constructed and arranged to interface with the shell casing in a chamber and to extract the shell casing from the chamber and wherein the first and second ejectors are constructed and arranged to push the shell casing away from the bolt face thereby pivoting the shell casing substantially about the extractor.

16. The apparatus of claim 15, wherein the first and second distances between the extractor plane and the first and second normal ejector planes are equal to approximately 50% to 70% of the width of the bolt face.

17. The apparatus of claim 15, wherein the first and second distances between the extractor plane and the first and second normal ejector planes are equal to approximately 55% to 65% of the width of the bolt face.

18. The apparatus of claim 15, wherein the first and second distances between the extractor plane and the first and second normal ejector planes are substantially equal.

19. The apparatus of claim 15, wherein the first and second distances between the extractor plane and the first and second normal ejector planes are equal to approximately 60% of the width of the bolt face.

20. The apparatus of claim 15, further comprising:

a barrel comprising a chamber located at a first end of the barrel;

a gas port in the barrel;

a receiver positioned at the first end of the barrel; and a bolt-carrier in the receiver that carries the bolt assembly.

21. The apparatus of claim 20, wherein the apparatus is a gas operated, high-powered rotating-bolt type rifle.

22. The apparatus of claim 20, wherein the gas port is positioned approximately 18.1 cm to approximately 31.8 cm away from the chamber.

23. The apparatus of claim 20, wherein the bolt-carrier is constructed and arranged to cycle in approximately 0.060 seconds to approximately 0.100 seconds.

24. A firearm, comprising:

a barrel comprising a chamber located at a first end of the barrel;

a gas port in the barrel;

a receiver positioned at the first end of the barrel; and a bolt-carrier in the receiver, the bolt-carrier comprising a bolt assembly comprising: a bolt head, a bolt face, an extractor and a first and second ejector, wherein the bolt head defines a first and second channel that receive the first and second ejectors, wherein the bolt head defines a longitudinal axis, an extractor plane and a first and second radial ejector plane, wherein the extractor plane substantially bisects the extractor, wherein the first radial ejector plane substantially bisects the first channel, wherein the second radial ejector plane substantially bisects the second channel and wherein the longitudinal axis lies on each of the extractor plane and the first and second radial ejector plane;

wherein the first and second channels are positioned on opposite sides of the extractor plane;

wherein a first angle between the extractor plane and the first radial ejector plane is between approximately $3\pi/9$ and $7\pi/9$ radians;

wherein a second angle between the extractor plane and the second radial ejector plane is between approximately $3\pi/9$ and $7\pi/9$ radians; and wherein the extractor is constructed and arranged to interface with a shell casing in the chamber and to extract the shell casing from the chamber and wherein the first and second ejectors are constructed and arranged to push the shell casing away from the bolt face when the shell casing is extracted from the chamber thereby pivoting the shell casing substantially about the extractor and ejecting the shell casing from the receiver.

* * * * *